United States Patent [19]

Crossley

[11] 3,986,868

[45] Oct. 19, 1976

[54] TITANIUM BASE ALLOY

[75] Inventor: Frank A. Crossley, Palo Alto, Calif.

[73] Assignee: Lockheed Missiles & Space Company, Inc., Sunnyvale, Calif.

[22] Filed: Sept. 2, 1969

[21] Appl. No.: 854,510

[52] U.S. Cl. ..... 75/175.5; 148/32

[51] Int. Cl.[2] ..... C22C 14/00

[58] Field of Search ..... 75/175.5; 148/32, 32.5

[56] References Cited

UNITED STATES PATENTS

| | | | |
|---|---|---|---|
| 2,779,677 | 1/1957 | Jaffee et al. | 75/175.5 |
| 2,893,864 | 7/1959 | Harris et al. | 75/175.5 |
| 3,113,227 | 12/1963 | Bomberger et al. | 75/175.5 |
| 3,306,739 | 2/1967 | Evans et al. | 75/175.5 |
| 3,615,378 | 10/1971 | Bomberger | 75/175.5 |

FOREIGN PATENTS OR APPLICATIONS

| | | | |
|---|---|---|---|
| 552,544 | 5/1957 | Belgium | 75/175.5 |
| 575,487 | 5/1959 | Canada | 75/175.5 |
| 1,116,683 | 2/1956 | France | 75/175.5 |
| 814,940 | 6/1959 | United Kingdom | 75/175.5 |
| 848,905 | 9/1960 | United Kingdom | 75/175.5 |
| 1,079,416 | 8/1967 | United Kingdom | 75/175.5 |
| 757,383 | 9/1956 | United Kingdom | 75/175.5 |
| 1,124,324 | 8/1968 | United Kingdom | 75/175.5 |

*Primary Examiner*—C. Lovell

*Attorney, Agent, or Firm*—Richard H. Bryer; George C. Sullivan

[57] ABSTRACT

A titanium base alloy combining high formability, high strength, high hardenability and weldability. There is a beta stabilizer (columbium, cobalt, chromium, iron, manganese, molybdium, nickel, tantalum or vanadium). In addition, aluminum, tin and zirconium are included. Vanadium is the preferred beta stabilizer in an amount of 7.5 to 14.5 weight percent, with aluminum at 1 to 5 weight percent and tin and zirconium at 1 to 15 weight percent each.

24 Claims, 7 Drawing Figures

FIG. 1
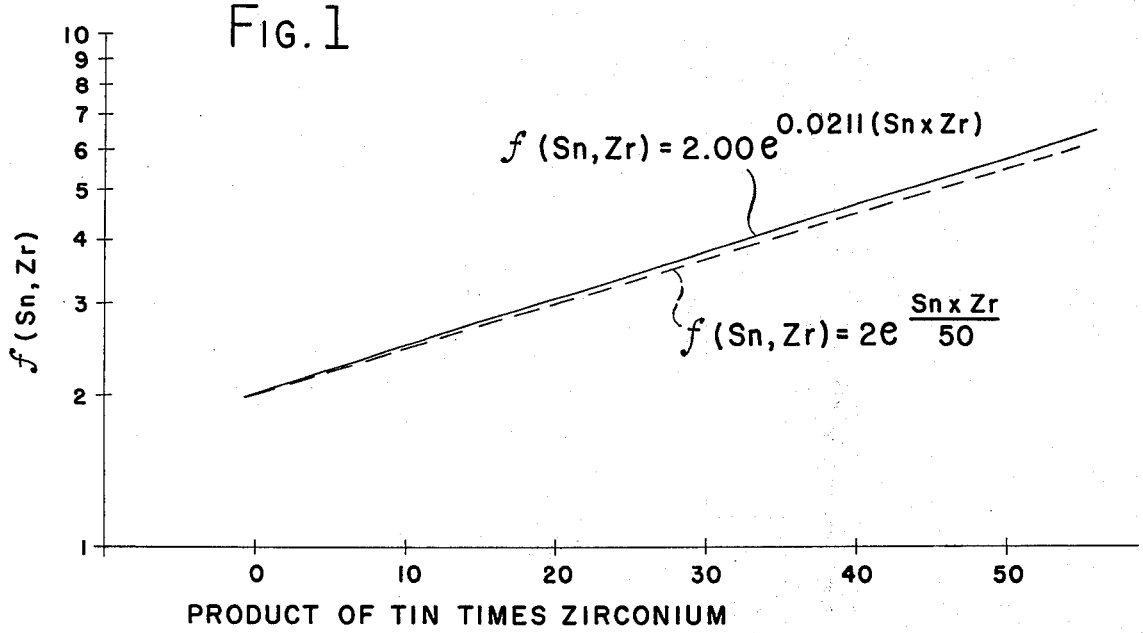
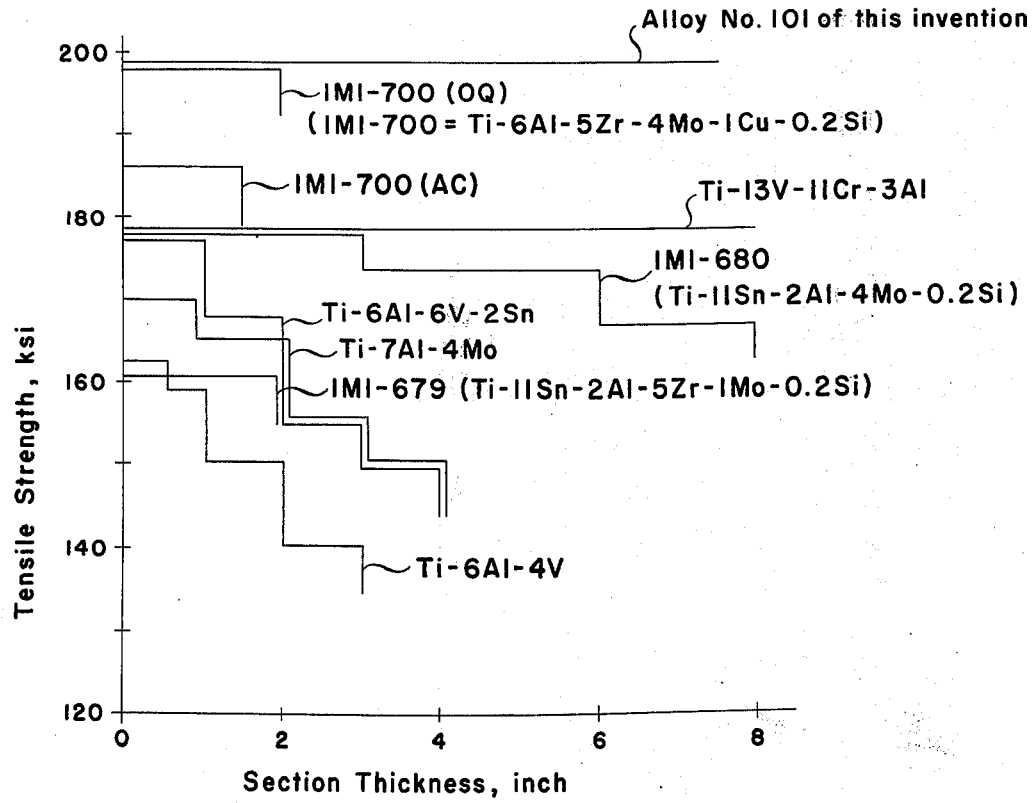
FIG. 7
INVENTOR.
FRANK A. CROSSLEY
BY George C. Sullivan
Agent
Richard H. Boyer
Attorney INVENTOR.
FRANK A. CROSSLEY
BY George C. Sullivan Agent
Richard H. Bryer Attorney

INVENTOR.
FRANK A. CROSSLEY

BY George Cullman
Agent

Richard H. Breyer
Attorney

INVENTOR.
FRANK A. CROSSLEY
BY George C. Sullivan
Agent
Richard H. Boyer
Attorney

*INVENTOR.*
FRANK A. CROSSLEY
*BY* George Sullivan
Agent
Richard H. Bryer
Attorney

TITANIUM BASE ALLOY

This invention relates to an improved titanium base alloy.

The invention constitutes a new class of titanium base alloys which upon air cooling from the high temperature body centered cubic (bcc) beta phase filed, transofrm martensitically, either during cooling to room temperature or lower temperature, or upon plastically deforming after having cooled to room or lower temperature. These alloys do not transform during or after cooling by the nucleation and growth mechanism which produces structures commonly designated by terms such as Widmanstatten, acicular and basket weave, exemplified by the well-known commercial alloy Ti6Al-4V. Neither do these alloys retain metastable all-beta structures, as exemplified by the commercial alloy B120VCA, Ti-13V-11Cr-3Al.

The air-cooled martensitic or partially martensitic structures of this invention represent a complete departure from conventional titanium alloy technology. The preferred alloys of this invention transform upon air cooling to a soft martensite plus beta, which can be age-hardened to high-strength levels in excess of 200,000 psi at 0.2 percent yield strength. Since weld metal and base metal are soft in the as-welded condition, yielding readily occurs to relieve thermal and mechanical stresses induced by the welding process. Artificial aging brings both the base metal and the weld metal to high-strength levels. Moreover, the preferred alloys of this invention display good ductility in high-strength conditions.

The combination of high strength, weldability, and ductility especially recommends the alloys of this invention for heavy section applications where weldability is desirable. For example, they are recommended as hull materials for deep-submergence vehicles, or for heavy forgings and castings. These are applications for which current commerical titanium alloys have been particularly wanting for one reason or another. The alloys of this invention may also be used to advantage in applications now served by current commercial titanium alloys.

An important advantage of the alloys of this invention lies in their combination of high formability, high strength, high hardenability weldability, and ready producibility, whereas individual commercial titanium alloys possess some but not all of these characteristics to the same extent.

Perhaps the most significant advantage of the alloys of this invention is their exceptional hardenability. Selected alloys of this invention have such high hardenability that four-inch sections can be expected to transform martensitically upon air cooling. This unique characteristic is possessed by no commercial titanium base alloy. If water quenching or spray cooling is employed to speed the time of cooling, or in order to get the desired structure in sections even thicker than four inches, there is no necessity for rapid transfer from the solution-treating furnace to the quench medium, as there is for conventional alpha-beta titanium alloys.

Another important advantage is the ease of fabrication of the alloys of this invention, for all processing can take place in the high-temperature beta phase field. Good cold formability, through deformation transformation of the retained metastable beta is indicated by alloy compositions selected to consist predominantly or entirely of metastable beta.

There is the further advantage of high strength combined with weldability and acceptable ductility in heavy sections. While many titanium alloys are capable of developing high strength, use of current commercial titanium alloys in their high-strength conditions is highly circumscribed by such factors as section size, welding requirement, impact resistance, notch sensitivity, and stress corrosion susceptibility.

The strength advantage of the alloys of this invention is readily apparent in applications such as the hull of a deep-submergence vehicle for a 20,000-foot depth capability. For this application, weldability, toughness, and immunity to sea water accelerated crack growth are required. These requirements impose such restrictions that qualifying titanium alloys are currently limited in 0.2 pct. yield strength to 100,000 to 110,000 psi. These strengths represent their mill-annealed conditions. Of alloys now commercially available, only alpha-beta alloys appear to meet the requirements. While these alloys can be heat treated to higher strength levels, a rapid quench (e.g. water quench) from high in the two-phase alpha-beta field is necessary. Because of the limited hardenability of these alloys, heat treatment effectiveness is limited to sections thinner than one inch. Hulls for deep submergence vehicles of 20,000-foot depth capability would require heat treatment of four-inch thick plate. The alloys of this invention can be expected to achieve yield strengths of at least 150,000 psi in four-inch thick plate, while maintaining adequate toughness. Therefore, a strength advantage of 36 percent or more can be obtained as compared to the titanium alloys now being considered for use for hulls of deep submergence vehicles.

The predominant use for titanium has heretofore been as jet engine components operating at elevated temperatures. This usage has dominated alloy development and has been responsible for one of the two lines of development of commercial, titanium base alloys. This line is represented by the weldable all-alpha, near-alpha, and predominantly alpha alloys. Near alpha or predominantly alpha alloys contain beta as a minority phase. They are a consequence of the fact that the low temperature allomorph of titanium, hexagonal close-packed (hcp) alpha existing at temperatures below 1525° F for unalloyed titanium, is inherently more creep resistant than the high temperature allomorph body-centered cubic (bcc) beta existing between 1525° F and the melting point. In order to maximize the strength-to-density ratio, the predominantly alpha alloys have relied on aluminum, for the most part, to strengthen the alpha phase. Tin and zirconium have been used as secondary alpha solid solution strengtheners, in combination with aluminum, and in a few instances, tin has been used as the predominant alpha solid solution strengthener. However, the amount of aluminum that can be added has been limited by the occurrence of embrittlement associated with the first intermediate phase in the Ti-Al system, $Ti_3Al$. For example, for stability under conditions of elevated temperature creep exposure conditions, the limits of alpha solid solution alloying is given by the empirical expression:

$$\text{wt pct Al} + \tfrac{1}{3}\,\text{wt pct Sn} + 1/6\,\text{wt pct Zr} \leq 9.$$

Sea water stress corrosion has imposed further limits on alpha solid solution alloying, particularly as to aluminum content. As a consequence, alloys for marine applications have been limited in aluminum content to less than 7 wt. pct.

The solution-treated and aged (STA) strength of predominantly alpha alloys increases with increasing beta-to-alpha ratio, due to increasing content of beta stabilizing additions. However, if weldability is desired in conventional alpha-beta or predominantly alpha alloys, then the content of beta stabilizing additions is limited. The alloying restrictions imposed by the requirements of welding and immunity for sea-water-accelerated crack growth have limited 0.2 percent offset yield strength of candidate titanium alloys for deep submergence vehicle hull applications to about 110,000 psi. in the mill annealed condition. Higher strength can be obtained by heat treatment, but then a rapid water quench from high in the two-phase alpha-beta phase field is necessary. Effectiveness of heat treatment is limited to section sizes of one inch or less, because of the low hardenability of these alloys.

Efforts to overcome the strength limitations of the weldable, predominantly alpha alloys led to the development of the second type of weldable titanium alloys, that is, the age hardenable, meta-stable beta alloys, such as B120-VCA (Ti-13V-11Cr-3Al), Beta III (Ti-12Mo-6Sn-4.5Zr), and Ti-8Mo-8V-2Fe-3Al alloy. These alloys have achieved much higher strength levels than the predominantly alpha type in heavy section, since the beta phase was retained upon relatively slow cooling. However, the Ti-13V-11Cr-3Al alloy is only marginally weldable, and is notch sensitive.

Compared to the predominantly alpha (hcp) alloys, the beta alloys (bcc) have or may be expected to have poorer resistance to impact, greater notch sensitivity, and greater sensitivity to the interstitially sobuble impurities, especially hydrogen and oxygen. These lesser characteristics are attributable to inherent differences in the hcp and bcc crystal lattices.

The alloys of this invention obtain the best characteristics of the bcc matrix alloys and also the best characteristics of hcp matrix alloys. They do this by retaining the bcc structure upon relatively slow cooling and transforming at relatively low temperatures to the hcp structure, entirely or partially, by a martensitic or massive type transformation that does not depend upon long-range diffusion. This new alloy is weldable because the hcp product phase or hcp plus retained beta phase is relatively soft and ductile. High strength is achieved by age hardening.

A unique and primary characteristic of the alloys of the instant invention, which distinguishes them from all other commercial titanium alloys, is that they transform partially or completely to martensite either upon relatively slow cooling from above the beta transus to room temperature, or below, or later upon the application of stress. That is, the alloys of this invention undergo stress-induced or strain-induced transformation. This stress-induced or strain-induced martensitic transformation is manifested as plasticity in the direction of the applied stress. A second primary characteristic of these new alloys is their age hardening.

Other objects and advantages of the invention will appear from the following description.

In the drawings:

FIG. 1 is a semilogarthmic graph of the logarithm of a certain function of tin and zirconium in a titanium base alloy plotted against the product of weight percents of tin and zirconium therein as explained below relative to equations 12 and 13;

FIG. 7 is a graph of tensile strength gainst section thickness for an alloy of this invention and for several other alloys shown for the sake of comparison.

Figure 2:
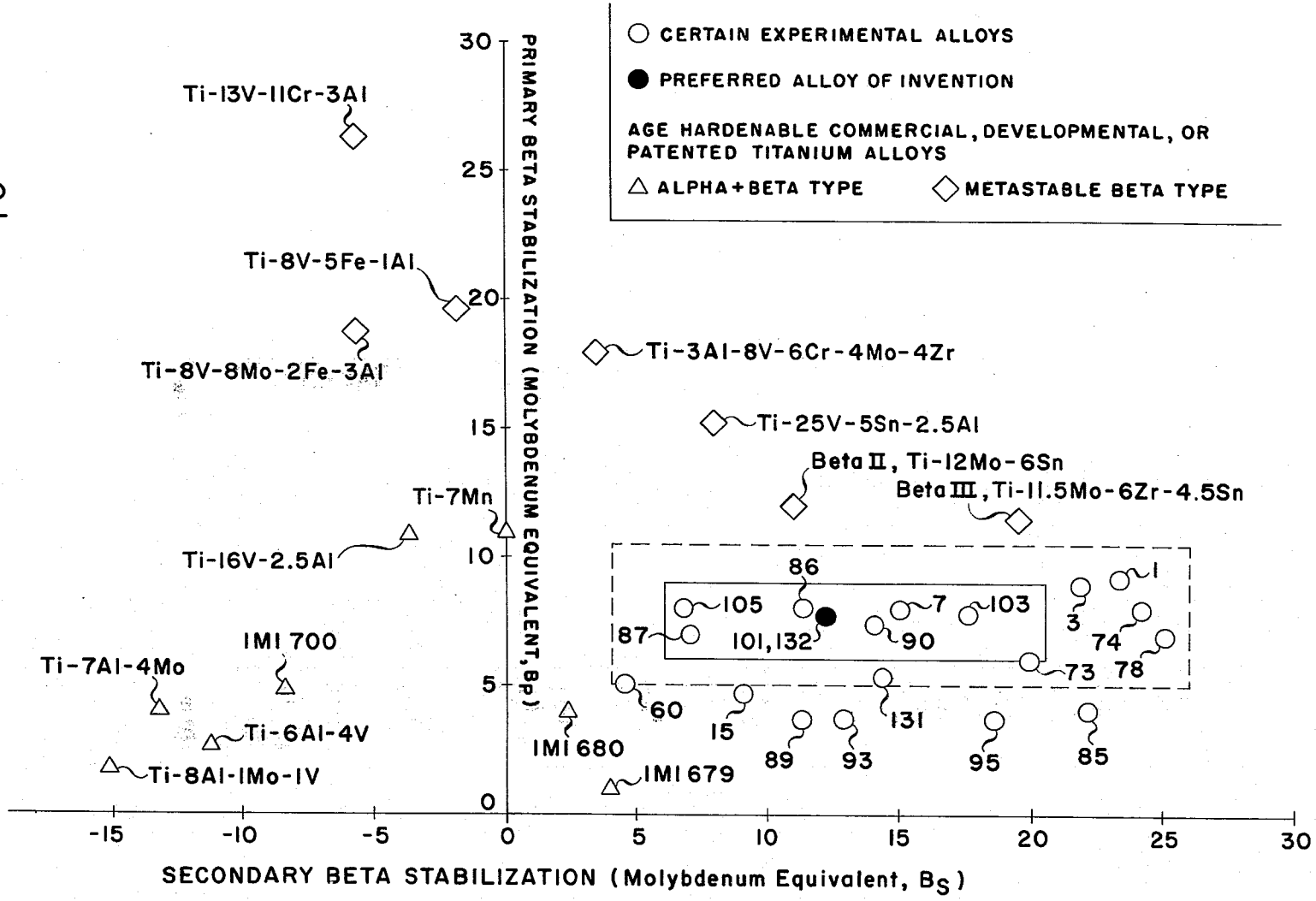
FIG. 2 is a graph plotting $B_P$ versus $B_S$, as defined below for various alloys of this invention (within a rectangular area enclosed by broken lines) and for various prior art alloys. A preferred group of alloys of this invention lies within a solid line rectangle.

Metastable beta of titanium alloys can transform during cooling by three mechanisms: (1) nucleation and growth to produce a Widmanstatten alpha beta structure; (2) diffusionless shear to produce martensitic product; and (3) transformation (apparently by diffusionless shear) to produce omega, a submicroscopic coherent precipitate associated with embrittlement. The primary obstacle to the achievement of the second reaction at cooling rates short of a rapid quench of a relatively light section is the occurrence of the first reaction. That is, the attainment of a homogeneous martensitic structure is precluded by the diffusion dependent, nucleation and growth transformation to produce the familiar acicular or basket weave structure. The basic alloying problem is to suppress the nucleation and growth reaction at slow cooling rates without stabilizing the beta to such extent that a so-called all-beta alloy such as Ti-13V-11Cr-3Al, is formed. Since martensite is a metastable phase, it, as well as beta, undergoes aging reactions. These aging reactions provide bases for age hardening. Additional hardening may result if a compound former which has high solubility in beta, but low solubility in alpha (e.g., silicon) is added in minor amount to the alloy. This alloying addition would be expected to be retained in beta solid solution and to precipitate from the transformation product, martensite. In order to understand how this is achieved in the alloys of this invention, it is necessary to examine the alloying effects of the various elements commonly used in titanium base alloys.

Primary Beta Stabilizers

The effective beta stabilizers in titanium fall into two groups: the isomorphous beta stabilizers Cb, Mo, Ta, and V; and the (slow) eutectoid beta stabilizers such as Co, Cr, Fe, Mn, Fe, and w. The most important role of primary beta stabilizers in the alloys of the present invention is to establish the Ms temperature; and therefore, the ratio of alpha to beta in the annealed condition. An ancillary function of these elements is to make the nucleation and growth transformation more sluggish. That is, the time-temperature-transformation (TTT) curves for the precipitation of alpha from beta is moved toward longer times.

A convenient means for comparing the beta stabilizing potentials of the various elements is to rationalize them to molybdenum on the basis of the amount, in weight percent, required to retain soft beta upon rapid cooling from the beta phase field. These data and the molybdenum equivalent (Mo Eq) of 1 weight percent (i.e., specific molybdenum equivalent) of the commercially important beta stabilizers are given in Table 1.

Beta stabilizing efficiency, the ratio of the specific Mo Eq to the density of the element is also given.

TABLE 1

RATING OF PRIMARY BETA STABILIZERS IN TERMS OF MOLYBDENUM EQUIVALENTS

| Element | Quantity Needed to Retain Beta Upon Rapid Quench From Beta Weight Percent | Specific Molybdenum Equivalent MoEq/wt pct | Density lb/cu in | Beta Stabilizing Efficiency Specific Mo Eq/ Density |
|---|---|---|---|---|
| Cb (Nb) | 36 | 0.28 | 0.310 | 0.90 |
| Co | 7 | 1.43 | 0.322 | 4.4 |
| Cr | 6.3 | 1.59 | 0.260 | 6.1 |
| Cu | 13 | 0.77 | 0.324 | 2.4 |
| Fe | 3.5 | 2.85 | 0.284 | 10.0 |
| Mn | 6.4 | 1.56 | 0.27 | 5.8 |
| Mo | 10 | 1.00 | 0.369 | 2.7 |
| Ni | 9 | 1.11 | 0.322 | 3.4 |
| Ta | 45 | 0.22 | 0.600 | 0.4 |
| V | 15 | 0.67 | 0.220 | 3.0 |

Secondary Beta Stabilizers

Tin and zirconium have been identified as "secondary beta stabilizers". Both tin and zirconium depress the beta transus of titanium to some extent and may therefore be expected to have some capacity, albeit small, to stabilize beta. However, both tin and zirconium have high solubilities in alpha titanium contrary to the behavior of primary beta stabilizers. Because of this characteristic and because of their ability to strengthen the alpha phase, they are commonly identified along with aluminum as alpha strengtheners, or promoter additions. A key discovery in the development of the alloys of this invention is that when tin and zirconium are added to titanium alloys with one or more primary beta stabilizers, they contribute to the stabilization of the beta phase with respect to nucleation and growth transformation. Another such key discovery is that this stabilization is proportional to the Mo Eq of the primary beta stabilizing addition. Furthermore, tin and zirconium in combination with one or more primary beta stabilizers have a remarkable synergistic effect of suppression of the nucleation and growth transformation of beta.

In the following discussion, certain symbols are used which are defined as follows:

1. Bp - beta stabilization of a single primary beta stabilizing element rationalized in terms of equivalents units (weight percent) of molybdenum, and based upon the amount of the element required to retain soft beta upon rapid quench from the beta.
2. Bs - secondary beta stabilization of high alpha solubility elements (such as tin, zirconium, and aluminum) and based upon their effects on the nucleation and growth transformation of beta upon slow cooling.
3. $B_P$ - total contribution to primary beta stabilization of additions in a given alloy — summation of molybdenum equivalents of primary beta stabilizing additions.
4. $B_S$ - total contribution to secondary beta stabilization of additions in a given alloy — summation of molybdenum equivalents of tin, zirconium, and aluminum additions.
5. $B_T$ - total beta stabilization of a given alloy, the sum of $B_P$ and $B_S$.

In order to place the beta stabilizing effects of tin and zirconium on a quantative basis, alloys were made having various levels of primary beta stabilization from 0.5 to 7.8 MoEq and with single and combined additions of tin and zirconium. One-eighth inch thick specimens of these alloys were air cooled from the beta phase field and their microstructures examined. Compositions producing essentially the same microstructure were considered to have the same total beta stabilizing capacity (i.e., $B_T$) with respect to nucleation and growth transformation. Comparison of microstructures was most easily made for compositions just sufficient to completely suppress precipitation of primary alpha at grain boundaries (and thus consisting predominantly or entirely of martensite). Therefore, wherever possible such microstructures were made the basis of the calculations of the beta stabilizing effects of tin and zirconium. The secondary beta stabilization contributions, $B_S$, of tin and zirconium, are added to the primary stabilization, $B_P$, to give the total, $B_T$:

$$B_T = B_P + B_S \quad (1)$$

The compositional and microstructural data used to calculate the beta stabilizing contribution of tin and zirconium are summarized in Table II. The alloy numbers correspond to those given later in Table VI.

TABLE II

| Alloy No. | Composition, weight percent Fe | Mo | V | Sn | Zr | Other | $B_p$* | Microstructure as Air Cooled from Beta Sheet Specimens ⅛ inch thick | $B_T$ |
|---|---|---|---|---|---|---|---|---|---|
| 23 | | 3.0 | | | 10 | 0.15Si | 3.0 | 5–10% $\alpha + \alpha'$ | 6.6 |
| 25 | | 3.0 | | 10 | | 0.15Si | 3.0 | $\alpha'$ + (some very fine W due to dendritic segregation) | 7.5 |
| 41 | | | | | 10 | 8 Cu | 6.2 | very fine pearlite structure | 7.4 |
| 42 | | | | 10 | | 8 Cu | 6.2 | Nodular pearlite center, bainite appearance outside | 9.3 |
| 44 | 2.0 | 2.1 | | | | | 7.8 | 1% $\alpha + \alpha'$ | 7.8 |
| 45 | 2.0 | 2.1 | | 1 | | | 7.8 | $\alpha'$ | 9.0 |
| 48 | 1.0 | 2.2 | | | | | 5.0 | 5–10% $\alpha + \alpha'$ | 5.0 |
| 49 | 1.0 | 2.2 | | 1 | | | 5.0 | ~10% $\alpha + \alpha'$ | 5.8 |

TABLE II-continued

| Alloy No. | Composition, weight percent Fe | Mo | V | Sn | Zr | Other | $B_P$* | Microstructure as Air Cooled from Beta Sheet Specimens ⅛ inch thick | $B_T$ |
|---|---|---|---|---|---|---|---|---|---|
| 50 | 1.0 | 2.2 | | 3 | | | 5.0 | ~5% $\alpha + \alpha'$ | 7.2 |
| 51 | 1.0 | 2.2 | | 5 | | | 5.0 | $\alpha'$ | 8.8 |
| 52 | 1.0 | 0.8 | | 3 | | | 3.6 | W | 5.2 |
| 53 | 1.0 | 0.8 | | 5 | | | 3.6 | W | 6.3 |
| 54 | 1.0 | 0.8 | | 7 | | | 3.6 | W | 7.4 |
| 55 | 1.0 | 0.8 | | 9 | | | 3.6 | 10–15% $\alpha + \alpha'$ | 8.5 |
| 58 | | | 10.5 | 1 | | | 7.0 | very, very fine $\alpha'$ | 8.1 |
| 59 | | | 6.0 | 2 | 1.5 | | 4.0 | very, very fine $\alpha'$ | 8.0 |
| 63 | | | 4.5 | 2 | 5 | | 3.0 | very, very fine $\alpha'$ | 8.1 |
| 68 | | | 1.5 | 5 | 10 | | 1.0 | $\alpha'$ | 8.4 |
| 118 | 1.0 | 0.8 | | 11 | | | 3.6 | $\alpha'$ + ~5% $\beta$ | 9.5 |
| 125 | 1.0 | 2.2 | | | 5 | | 5.0 | 1% $\alpha + \alpha'$ | 8.0 |
| 128 | 1.0 | 0.8 | | | 11 | | 3.6 | ~25% $\alpha + \alpha'$ | 8.4 |
| 129 | 1.0 | 0.8 | | | 13 | | 3.6 | ~30% $\alpha + \alpha'$ | 9.2 |
| 130 | 1.0 | 0.8 | | | 15 | | 3.6 | ~30% $\alpha + \alpha'$ | 10.1 |

$\alpha'$ - martensite
$\alpha$ - primary (nucleation and growth) alpha
$\beta$ - beta
W - Widmanstätten $\alpha + \beta$
$B_P$= - total beta stabilization due to primary beta stabilizer(s) in molybdenum equivalents $Bs_{Sn}$ Cursory examination of a number of alloys made it quite apparent that the effect of a given tin addition was a function of the quantity of primary beta stabilizer present. The beta stabilizing effect of tin was assumed to be of the form:

$$Bs_{Sn} = B_P \times kSn \text{ (weight percent)} \quad (2)$$

Substituting Equation 2 for $B_S$ in Equation 1 and simplifying $$B_T = B_P\,(1 + k(\text{Sn})) \quad (3)$$

Reference to Table II shows that alloys Nos. 45 and 51 have essentially the same microstructure, i.e., apparently all martensite. Equating $B_T$ for alloys Nos. 45 and 51 and making the proper substitutions from Table II we get:

$$5.0(1 + k(5)) = 7.8(1 + k(1))$$

Solving for *k:*

$$k = 0.163 \quad (4)$$

Comparison of tin contents and microstructures of alloys Nos. 55 and 118 with No. 45 suggests that an alloy of the composition: Ti-10.5Sn-0.8Mo-1Fe would have the same microstructure as No. 45. Therefore, it follows that $$3.6(1 + k(10.5)) = 7.8(1 + K(1))$$

and $$k = 0.140 \quad (5)$$

Averaging these results (Equations 4 and 5) gives a practical *k* as $$k = 0.15 \quad (6)$$

and, therefore, $$Bs_{Sn} = 0.15\,B_P(\text{Sn}) \quad (7)$$

$Bs_{Zr}$

The beta stabilizing effect of zirconium was determined by a similar analysis. It may be noted from Table II that alloys Nos. 55 and 128 have very similar microstructures. It was assumed from this fact that 11 weight percent Zr is equivalent to 9 weight percent Sn; and therefore that $$\text{Zr} \equiv 0.82\ \text{Sn} \quad (8)$$

Also, it may be noted that the microstructure of alloy No. 125 lies between those of alloys Nos. 50 and 51. It follows that 3 weight percent Sn < 5 weight percent Zr < 5 weight percent Sn or $$\text{Zr} \sim 0.8\ \text{Sn} \quad (9)$$

Furthermore, comparisons of alloy pairs having the same primary beta stabilizing addition and having either tin or zirconium in the amount of 10 weight percent (Nos. 22 with 23 and 41 with 42) led to the conclusion that tin is a somewhat more potent beta stabilizer than zirconium. The microstructures of the alloys with 10 weight percent Sn addition reflect greater hardenability than the comparable alloy with 10 weight percent Zr. Therefore averaging the results of Equations 8 and 9, $$Bs_{Zr} = 0.12\,B_P\,(\text{Zr}) \quad (10)$$

Comparison of alloys containing both tin and zirconium over a wide range of $B_P$ values indicated that these two elements have a strong synergistic effect in stabilizing beta. It was assumed that, when tin and zirconium are both present, the relationship between composition and $B_T$ is of the form $$B_T = B_P\,(1 + 0.15\text{Sn} + 0.12\text{Zr}) + f(\text{Sn,Zr}) \quad (11)$$

The similarities of microstructures of alloys Nos. 58 and 59 (exceptionally fine martensite) led to the assumption that they have equivalent values of $B_T$, and therefore $$7.0(1 + 0.15\times1) = 4.0(1 + 0.15\times2 + 0.12\times1.5) + f(\text{Sn,Zr})$$

Solving for $f$(Sn,Zr) gives $$f(\mathrm{Sn,Zr}) = 2.13$$

and it may be noted that the Sn × Zr product of alloy No. 59 is 3.

Comparison of the microstructures of alloys Nos. 63 and 58 led to the assumption that the former has $B_T$ less than or equal to that of the latter. Substituting in Equation 11 it follows that $$7.0(1 + 0.15\times1) \geqq 3(1 + 0.15\times2 + 0.12\times10) + f(\mathrm{Sn,Zr})$$

and $$f(\mathrm{Sn,Zr}) \leqq 2.35 \text{ while } \mathrm{Sn} \times \mathrm{Zr} = 10$$

Again alloys Nos. 45 and 68 have equivalent microstructures, apparently 100 percent martensite. Assuming their $B_T$ values are equal:

$$7.8(1 + 0.15\times1) = 1.0(1 + 0.15\times5 + 0.12\times10) + f(\mathrm{Sn,Zr})$$

and $$f(\mathrm{Sn,Zr}) = 6.0 \text{ while } \mathrm{Sn} \times \mathrm{Zr} = 50.$$

Plotting the logarithm of $f$(Sn,Zr) versus the Sn × Zr product produced the linear relationship shown in FIG. 1. A least squares solution of the data gave $$f(\mathrm{Sn,Zr}) = 2.00e^{0.0211\,\mathrm{Sn}\times\mathrm{Zr}} \quad (12)$$

This equation may be simplified with negligible effect on accuracy to $$f(\mathrm{Sn,Zr}) = 2e^{\mathrm{Sn}}\times^{\mathrm{Zr}/50} \quad (13)$$

Consequently, for alloys containing both tin and zirconium Equation 11 becomes $$B_T = B_P(1 + 0.15\mathrm{Sn} + 0.12\mathrm{Zr}) + 2e^{\mathrm{Sn}}\times^{\mathrm{Zr}/50} \quad (14)$$

Role of Aluminum

Earlier investigators found that a 2 weight percent aluminum addition depressed the Ms when added to a Ti-6Cr base. Another investigator reported that binary aluminum additions lower the Ms slightly up to about 6 weight percent at which point Ms increased. That aluminum in large amounts raises the Ms is evident from a comparison of Ms values for Ti-4V and Ti-6Al-4V. One investigator found that Ms for the Ti-4V alloy is 1380° F (750° C), while another investigator found it to be 1310° F (710° C). The average of these two results may be compared with the Ms of 1700° F (925° C) reported for Ti-6Al-4V by a third investigator. On the other hand, comparison of TTT diagrams of titanium-beta stabilizer binary alloys with analogous alloys having ternary additions of aluminum shows that aluminum accelerates the nucleation and growth transformation of beta. Tin and zirconium were observed to depress the Ms in the current study. The observation with respect to tin is supported by the finds of others, that tin in amounts up to 8 weight percent lower the Ms. Thus, aluminum in lower amounts behaves uniquely in comparison with other metals commonly added to titanium alloys, in that it stabilizes beta with respect to the martensitic transformation, but makes nucleation and growth transformation occur more readily.

It is desirable to add aluminum to the alloys of the current invention in order to facilitate the addition of high melting primary beta stabilizers, particularly those of the beta-isomorphous group, through the use of master alloys. An additional benefit of aluminum drives from its potency as a solid solution hardener in titanium. Aluminum was found to have a profound effect on total beta stabilization. A quantitative estimate of this effect of aluminum was made in Table III, following, using the same means as discussed above to determine the beta stabilizing contributions of tin and zirconium.

TABLE III

| Alloy No. | Composition, weight percent Fe | Mo | Sn | Al | $B_P$ | Microstructure |
|---|---|---|---|---|---|---|
| 50 | 1.0 | 2.2 | 3 | | 5.0 | 5% $\alpha + \alpha'$ |
| 51 | 1.0 | 2.2 | 5 | | 5.0 | $\alpha'$ |
| 115 | 1.0 | 2.2 | 5 | 1 | 5.0 | up to 5% $\alpha + \alpha'$ |
| 44 | 2.0 | 2.1 | | | 7.8 | 1% $\alpha + \alpha'$ |
| 45 | 2.0 | 2.1 | 1 | | 7.8 | $\alpha'$ |
| 46 | 2.0 | 2.1 | 3 | | 7.8 | $\alpha'$ |
| 112 | 2.0 | 2.1 | 2 | 1 | 7.8 | 1–5% $\alpha$ + very fine $\alpha'$ |

Comparison of the data presented in Table III for alloys No. 50, 51 and 115 shows that 1 weight percent Al cancels the stabilizing effect of 2 weight percent Sn at $B_P = 5.0$, therefore $$5.0(1 + 0.15 \times 5) + Bs_{Al} = 5.0\,(1 + 0.15 \times 3)\; Bs_{Al} = -1.5 \quad (15)$$

Again comparison of alloys Nos. 44 and 112 shows that with respect to precipitation of primary alpha the latter has stabilization approximating that of the former. It follows that $$7.8 = 7.8(1 + 0.15 \times 2) + Bs_{Al}\; Bs_{Al} = -2.34 \quad (16)$$

Averaging the results of equations 15 and 16 gives $$Bs_{Al} = -1.9 \quad (17)$$

The full expression for calculating the beta stabilization of an alloy containing primary beta stabilizers, tin, zirconium, and aluminum is thus $$B_T = B_P(1 + 0.15\,\mathrm{Sn} + 0.12\mathrm{Zr}) + 2e^{\mathrm{Sn}} \times^{\mathrm{Zr}/50} - 1.9\mathrm{Al} \quad (18)$$

The validity of Equation 18 for measuring the beta stabilization may be checked by comparing $B_T$ values for alloys which have approximately the same microstructure, i.e., more than 98 percent martensite, but represent compositional extremes in terms of the mix of primary and secondary beta stabilizers. Alloys Nos. 45, 58 and 68 of Table II and 21 of Table VI represent such compositional extremes; their compositions, $B_P$ and calculated $B_T$ are given:

| Alloy No. | Composition (weight percent) | $B_P$ | $B_T$ | Deviation | $B_S$ |
|---|---|---|---|---|---|
| 21 | Ti-13Ta-10Zr | 2.9 | 6.4 | 1.6 | 3.5 |
| 45 | Ti-2.1Mo-2Fe-1Sn | 7.8 | 9.0 | 1.0 | 1.2 |
| 58 | Ti-10.5V-1Sn | 7.0 | 8.1 | −0.1 | 1.1 |
| 68 | Ti-1.5V-5Sn-10Zr | 1.0 | 8.4 | −0.4 | 7.4 |

$B_T$ average = 8.0
Average Deviation = 0.8

Considering the empirical nature of this correlation, the agreement is very good. It may be noted that the agreement between alloys Nos. 58 and 68 which involve the same primary beta stabilizing addition, is better than with Nos. 21 and 45. The larger deviation from the average $B_T$ for alloy No. 21 (Ti-13Ta-10Zr) may be due to the fact that the minimum quantity of tantalum needed to retain beta on water quenching is less accurately defined than for the other beta stabilizers. The parameter $B_S$ given in the last column above is the difference between $B_T$ and $B_P$ and is useful in comparing widely different alloy compositions as will be shown below. The expression for calculating $B_S$ is obtained by substracting $B_P$ from Equation 18, that is, $$B_S = B_P(0.15\text{Sn} + 0.12\text{Zr}) + 2e^{\text{Sn}} \times {}^{\text{Zr}/50} - 1.9\text{Al} \qquad (19)$$

In the course of the development of the alloys of this invention a large number of compositions were studied. The alloying additions and their ranges covered in this investigation are summarized in Table IV. The purposes served by the various alloys are summarized in Table V. All of the alloys evaluated in the course of this invention are listed in Table VI. This table gives compositions, beta stabilizing parameters, $B_P$, $B_S$ and $B_T$, hardness (Rockwell "C" scale) as air cooled and water quenched from the beta phase field, and the microstructure of ⅛-inch thick sheet materials air cooled from above the beta transus temperature.

TABLE IV

| Element | Range Covered, wt pct |
|---|---|
| (1) Primary Beta Stabilizers | |
| Columbium | 2 – 3 |
| Copper | 2 – 8 |
| Iron | 1 – 2 |
| Manganese | 0.3 – 1 |
| Molybdenum | 0.3 – 3 |
| Tantalum | 4 – 20 |
| Vandium | 1 – 11.5 |
| (2) Secondary Beta Stabilizers or Transformation Retarders | |
| Tin | 1 – 11 |
| Zirconium | 1 – 17 |
| (3) Dispersion Hardeners (Compound Formers) | |
| Boron | 0.05 |
| Copper | 8 |
| Silicon | 0.1 – 1 |
| (4) Solid Solution Hardener | |
| Aluminum | 1 – 7 |

TABLE V

| Purpose Served | Alloy Numbers | Molybdenum Equivalent of Primary Beta Stabilizers, $B_P$ |
|---|---|---|
| 1. Feasibility of concept | 1–15 | 3.1 – 11.4 |
| 2. Establishment of alloying additions necessary to produce structures consisting of $\alpha'$, $\alpha' + \omega$, $\alpha'$ or $\beta + \omega$ upon air cooling from the beta | | |
| a) Zr present, Sn and Ta absent | 22, 23, 41 | 2.8 – 6.2 |
| b) Sn present, Ta and Zr absent | 25 | 3.0 |
| c) Sn and Ta present, Zr absent | 20 | 4.4 |
| d) Sn and Zr present, Ta absent | 26, 31–43 | 3.8 – 8.4 |
| e) Ta and Zr present, Sn absent | 21 | 2.9 |
| 3. Simplist sysem (fewest components) | 21–25, 41–43 | 2.9 – 6.2 |
| 4. Least total alloy content | 22, 26 | 2.8 |
| 5. Effectiveness of Compound Formers as dispersion strengtheners | | |
| a) B | 31 | 3.5 |
| b) Cu | 41–43 | 6.2 |
| c) Si | 2–7, 9–30, 32–38 56, 57, 96–98, 107 | 2.7 – 12.0 |
| 6. Range of occurrence of Transage alloys | 6, 8, 58–87, 94 | 0.5 – 12.0 |
| 7. Determination of molybdenum equivalent, $B_s$, of Sn | 44–55 | 3.6 – 7.8 |
| 8. Determination of molybdenum equivalent, $B_s$, of Zr | 122–130 | 3.6 – 7.8 |
| 9. Determination of molybedenum equivalent, $B_s$, of Al | 109–121 | 3.6 – 7.8 |
| 10. Optimum alloy | | |
| a) Containing Si | 56, 57, 96–98, 107 | 2.7 – 9.4 |
| b) Si free | 99, 106, 108 | 4.0 – 8.7 |
| c) Si and Ta present | 16–18 | 3.5 – 4 |

TABLE V-continued

| Purpose Served | Alloy Numbers | Molybdenum Equivalent of Primary Beta Stabilizers, $B_P$ |
|---|---|---|
| d) Si present, Ta absent | 26–28, 32–40 | 2.8 – 8.4 |
| e) Si and Ta absent | 88–95, 100–105, 131, 132 | 3.0 – 10.7 |

TABLE VI

| Alloy No. | Composition, weight percent | | | | | | | | | | | | | | Hardness, $R_C$ | | β-AC Microstructure |
|---|---|---|---|---|---|---|---|---|---|---|---|---|---|---|---|---|---|
| | Si | Al | Cu | Fe | Cb | Mn | Mo | Sn | Ta | V | Zr | $B_P$ | $B_S$ | $B_T$ | β-AC | β-WQ | |
| 1 | | | 5 | | 3 | | 0.3 | 5 | 13 | 2 | 10 | 9.2 | 23.3 | 32.5 | 29.6 | 19.5 | $\alpha'+\beta$ |
| 2 | 0.5 | | | | 3 | | 0.3 | 5 | 13 | 2 | 10 | 5.3 | 15.8 | 21.1 | 29.4 | 31.0 | $\alpha'+\beta+\omega^*$ |
| 3 | 0.5 | | 5 | | 2 | | 0.3 | 5 | 13 | 2 | 10 | 8.9 | 22.8 | 31.7 | 20.8 | 28.0 | $\alpha'+\beta+\omega^*$ |
| 4 | 0.5 | 3 | 5 | | 2 | | | 5 | 13 | 2 | 10 | 8.6 | 16.5 | 25.1 | 34.7 | 33.0 | $\alpha'+\beta$ |
| 5 | 0.5 | 3 | 5 | | 3 | | 0.3 | 5 | 15 | 3 | 10 | 10.3 | 19.8 | 30.1 | 32.0 | 32.0 | ~8%$\alpha'+\beta+\omega^*$ |
| 6 | 0.5 | | 5 | | 3 | 1 | 1 | 5 | 15 | 2 | 10 | 11.9 | 28.6 | 40.5 | 28.4 | 27.0 | $\beta^*$ |
| 7 | 1 | | | | 3 | 0.3 | 0.3 | 2 | 20 | 3 | 10 | 8.0 | 15.0 | 23.0 | 21.4 | 28.7 | 34%$\alpha'+\beta+\omega^*$ |
| 8 | | | | | 3 | 1 | 1 | 5 | 20 | 3 | 10 | 9.8 | 24.5 | 34.3 | 25.7 | 23.7 | $\beta$ |
| 9 | 0.5 | | | | 3 | | 0.3 | 5 | 10 | 2 | 10 | 4.7 | 14.6 | 19.3 | 38.3 | 31.0 | $\alpha'+\beta$ |
| 10 | 0.5 | | | | 3 | | 0.3 | 5 | 10 | 1 | 10 | 4.0 | 13.2 | 17.2 | 34.7 | 28.0 | 50%$\alpha'+\beta^*$ |
| 11 | 0.5 | | | | 2 | | 0.3 | 5 | 10 | | 10 | 3.2 | 11.8 | 15.0 | 35.4 | 37.5 | $\alpha'+\beta+\omega^*$ |
| 12 | 0.5 | | 2 | | 2 | | 0.3 | 5 | 10 | 1 | 10 | 5.3 | 15.8 | 21.1 | 39.3 | 32.3 | $\alpha'+\beta$ |
| 13 | 0.5 | | 2 | | 2 | | 0.3 | 5 | 10 | | 10 | 4.6 | 14.4 | 19.0 | 41.2 | 39.2 | $\alpha'+\omega^*$ |
| 14 | 0.5 | 1 | 3 | | | | 0.3 | 5 | 10 | 2 | 10 | 6.2 | 16.0 | 22.2 | 38.0 | 32.0 | $\alpha'+\beta$ |
| 15 | 0.5 | 3 | | | 3 | | 0.3 | 5 | 10 | 2 | 10 | 4.7 | 8.9 | 13.6 | 43.3 | 33.9 | $\alpha'+\beta+\omega^*$ |
| 16 | 0.5 | | | | 2 | | 0.3 | 5 | 8 | 2 | 10 | 4.0 | 13.2 | 17.2 | 33.6 | 30.3 | $\alpha'$ |
| 17 | 0.5 | | | | 2 | | 0.3 | 5 | 6 | 2 | 10 | 3.5 | 12.3 | 15.8 | 24.0 | 23.6 | $\alpha'+\beta$ |
| 18 | 0.5 | | | | 2 | | 0.3 | 5 | 11 | 3 | 10 | 5.3 | 15.8 | 21.1 | 31.6 | 30.6 | 5–10%$\alpha+\alpha'$ |
| 19 | 0.5 | | | | 2 | | 0.3 | 5 | 10 | 2 | 5 | 4.6 | 9.5 | 14.1 | 29.8 | 25.8 | $\alpha'+\omega^*$ |
| 20 | 0.5 | | | | 2 | | 0.3 | 5 | 10 | 3 | | 5.3 | 4.0 | 9.3 | 31.2 | 23.8 | $\alpha'+\omega^*$ |
| 21 | 0.15 | | | | | | | | 13 | | 10 | 2.9 | 3.5 | 6.4 | 23.1 | 27.8 | $\alpha'$ |
| 22 | 0.15 | | | 1 | | | | | | | 10 | 2.8 | 3.4 | 6.2 | 21.5 | 31.2 | $\alpha+\alpha'+\omega^*$ |
| 23 | 0.15 | | | | | | 3 | | | | 10 | 3.0 | 3.6 | 6.6 | 25.9 | 31.0 | 5–10% $\alpha+\alpha'$ |
| 24 | 0.15 | | | | | | | 10 | 13 | | | 2.9 | 4.3 | 7.2 | 31.2 | 31.6 | $\alpha'$+5% $\beta$ |
| 25 | 0.15 | | | | | | 3 | 10 | | | | 3.0 | 4.5 | 7.5 | 28.4 | 37.9 | $\alpha'+\beta$ |
| 26 | 0.15 | | | 1 | | | | 5 | | | 10 | 2.8 | 10.9 | 13.7 | 36.5 | 33.6 | $\alpha'+\beta$ |
| 27 | 0.15 | | | | | | 3 | 5 | 4 | 3 | 10 | 5.9 | 16.9 | 22.8 | 35.8 | 29.2 | $(\beta\rightarrow\alpha')$ |
| 28 | 0.10 | | | | 2 | | 0.3 | 5 | 4 | 3 | 10 | 3.8 | 12.9 | 16.7 | 34.2 | 27.8 | $\alpha'+\beta$ |
| 29 | 0.20 | | | | 2 | | 0.3 | 5 | 4 | 3 | 10 | 3.8 | 12.9 | 16.7 | 35.0 | 28.8 | $\alpha'+\beta$ |
| 30 | 0.30 | | | | 2 | | 0.3 | 5 | 4 | 3 | 10 | 3.8 | 12.9 | 16.7 | 36.7 | 28.0 | $\alpha'+\beta$ |
| 31+ | | | | | 2 | | 0.3 | 5 | | 4 | 10 | 3.5 | 12.3 | 15.8 | 34.2 | 25.3 | $\alpha'>\beta$ |
| 32 | 0.15 | | | 1 | | | 1 | 5 | | | 10 | 3.8 | 12.9 | 16.7 | 34.2 | 44.8 | 5–10%$\alpha+\alpha'$ |
| 33 | 0.15 | | | 1 | | | 1 | 5 | | 1 | 10 | 4.5 | 14.2 | 18.7 | 35.4 | 43.3 | $\alpha'$+5% $\beta$ |
| 34 | 0.15 | 1 | | 1 | | | 1 | 5 | | 1 | 10 | 4.5 | 12.3 | 16.8 | 39.9 | 44.6 | 75%$\alpha'+\beta$ |
| 35 | 0.15 | 2 | | 1 | | | 1 | 5 | | 2 | 10 | 5.2 | 11.8 | 17.0 | 40.4 | 34.8 | $\alpha'$ |
| 36 | 0.15 | | 1 | 1 | | | 1 | 5 | | 2 | 10 | 6.0 | 17.1 | 23.1 | 41.2 | 34.8 | $\nu f \alpha'$ |
| 37 | 0.15 | 2 | 2 | 1 | | | | 5 | | 1 | 10 | 5.1 | 11.6. 16.7 | 41.3 | 34.7 | Segregation $\alpha'/\alpha+\alpha'$ | |
| 38 | 0.15 | 3 | 5 | 1 | | | 1 | 5 | | 2 | 10 | 9.0 | 17.3 | 26.3 | 50.4 | 38.6 | $\alpha'+\beta$ |
| 39 | | 3 | 5 | 1 | | | 1 | 5 | | 2 | 10 | 9.0 | 17.3 | 26.3 | 42.7 | 37.9 | 5%$\alpha+\beta+\omega^*$ |
| 40 | | 3 | 5 | | | | 2 | 5 | | 2 | 10 | 7.2 | 13.7 | 20.9 | 35.8 | 28.3 | Segregation $\alpha+\beta/\alpha'+\beta$ |
| 41 | | | 8 | | | | | | | | 10 | 6.2 | 7.4 | 13.6 | 30.6 | 47.1 | 5%$\alpha$+ Pearlite ($\alpha+Ti_2Cu$) |
| 42 | | | 8 | | | | | 10 | | | | 6.2 | 9.3 | 15.5 | 39.0 | 30.0 | Bainite + Pearlite ($\alpha+Ti_2Cu$) |
| 43 | | | 8 | | | | | 5 | | | 10 | 6.2 | 17.5 | 23.7 | 38.6 | 34.6 | Bainite ($\alpha+Ti_2Cu$) |
| 44 | | | | 2 | | | 2.1 | | | | | 7.8 | 0.0 | 7.8 | 31.6 | 45.6 | 1%$\alpha+\alpha'$ |
| 45 | | | | 2 | | | 2.1 | 1 | | | | 7.8 | 1.2 | 9.0 | 31.9 | 43.6 | $\alpha'$ |
| 46 | | | | 2 | | | 2.1 | 3 | | | | 7.8 | 3.5 | 11.3 | 32.4 | 41.2 | $\alpha'$ |
| 47 | | | | 2 | | | 2.1 | 5 | | | | 7.8 | 5.8 | 13.6 | 35.4 | 43.1 | $\alpha'$ |
| 48 | | | | 1 | | | 2.2 | | | | | 5.0 | 0.0 | 5.0 | 26.2 | 36.9 | 38 10%$\alpha+\alpha'$ |
| 49 | | | | 1 | | | 2.2 | 1 | | | | 5.0 | 0.8 | 5.8 | 30.8 | 39.9 | 10%$\alpha+\alpha'$ |
| 50 | | | | 1 | | | 2.2 | 3 | | | | 5.0 | 2.2 | 7.2 | 32.2 | 4.9 | ~5%$\alpha+\alpha'$ |
| 51 | | | | 1 | | | 2.2 | 5 | | | | 5.0 | 3.8 | 8.8 | 36.2 | 38.1 | $\beta'$ |
| 52 | | | | 1 | | | 0.8 | 3 | | | | 3.6 | 1.6 | 5.2 | 23.4 | 34.7 | Wid. $\alpha+\beta$; $\alpha>>\beta$ |
| 53 | | | | 1 | | | 0.8 | 5 | | | | 3.6 | 2.7 | 6.3 | 22.8 | 37.6 | Wid $\alpha+\beta$ |
| 54 | | | | 1 | | | 0.8 | 7 | | | | 3.6 | 3.8 | 7.4 | 26.2 | 37.1 | Wid. $\alpha+\beta$ |
| 55 | | | | 1 | | | 0.8 | 9 | | | | 3.6 | 4.9 | 8.5 | 30.9 | 43.6 | 10–15% $\alpha+\beta'$ |
| 56 | 0.15 | 5 | | | | | 2 | 5 | 3 | 10 | 4.0 | 3.7 | 7.7 | 45.5 | | $\alpha'$ | |
| 57 | 0.15 | 5 | | | | | 2 | 5 | | 1 | 10 | 2.7 | 1.2 | 3.9 | | | Severe coring 60–90%$\alpha+\alpha'$ |
| 58 | | | | | | | | 1 | | 10.5 | | 7.0 | 1.1 | 8.1 | 35.4 | 17.0 | $\nu\nu f \alpha'$ |
| 59 | | | | | | | | 2 | | 6 | 1.5 | 4.0 | 4.0 | 8.0 | 33.0 | 29.1 | $\nu\nu$ $\alpha'$ |
| 60 | | | | | | | | 2 | | 7.5 | 1.5 | 5.0 | 4.5 | 9.5 | 36.0 | 21.1 | $\nu\nu f \alpha'$ +~1% $\beta$ |
| 61 | | | | | | | | 2 | | 9 | 1.5 | 6.0 | 5.0 | 11.0 | 39.4 | 28.7 | $\nu\nu f \alpha'$ |
| 62 | | | | | | | | 2 | | 3 | 5 | 2.0 | 4.2 | 6.2 | 27.2 | 24.8 | $\alpha'$ |
| 63 | | | | | | | | 2 | | 4.5 | 5 | 3.0 | 5.1 | 8.1 | 34.0 | 26.7 | $\nu f \alpha'$ |

TABLE VI-continued

| Alloy No. | Composition, weight percent | | | | | | | | | | | | | | Hardness, $R_C$ | | β-AC Microstructure |
|---|---|---|---|---|---|---|---|---|---|---|---|---|---|---|---|---|---|
| | Si | Al | Cu | Fe | Cb | Mn | Mo | Sn | Ta | V | Zr | $B_P$ | $B_S$ | $B_T$ | β-AC | β-WQ | |
| 64 | | | | | | | | 2 | | 6 | 5 | 4.0 | 6.0 | 10.0 | 30.7 | 27.4 | α' |
| 65 | | | | | | | | 2 | | 7.5 | 5 | 5.0 | 6.9 | 11.9 | 36.1 | 26.3 | f α' |
| 66 | | | | | | | | 2 | | 9 | 5 | 6.0 | 7.8 | 13.8 | 37.0 | 23.8 | vv f α' |
| 67 | | | | | | | | 5 | | 0.75 | 10 | 0.5 | 6.4 | 6.9 | 21.7 | 26.7 | α' |
| 68 | | | | | | | | 5 | | 1.5 | 10 | 1.0 | 7.4 | 8.4 | 31.1 | 34.5 | α' |
| 69 | | | | | | | | 5 | | 3 | 10 | 2.0 | 9.3 | 11.3 | 30.5 | 32.8 | α' |
| 70 | | | | | | | | 5 | | 1.5 | 2 | 1.0 | 8.8 | 9.8 | 29.2 | 33.8 | α' |
| 71 | | | | | | | | 5 | | 3 | 12 | 2.0 | 11.0 | 13.0 | 30.8 | 30.6 | α' |
| 72 | | | | | | | | 5 | | 4.5 | 12 | 3.0 | 13.2 | 16.2 | 38.8 | 35.6 | α' |
| 73 | | | | | | | | 5 | | 9 | 12 | 6.0 | 19.8 | 25.8 | 16.6 | 25.4 | β |
| 74 | | | | | | | | 5 | | 12 | 12 | 8.0 | 24.2 | 32.2 | 26.2 | 22.5 | β |
| 75 | | | | | | | | 5 | | 1.5 | 14 | 1.0 | 10.6 | 11.6 | 30.3 | 32.7 | α' |
| 76 | | | | | | | | 5 | | 4.5 | 14 | 3.0 | 15.4 | 18.4 | 39.5 | 32.8 | vv f α' |
| 77 | | | | | | | | 5 | | 7.5 | 14 | 5.0 | 20.3 | 25.3 | 23.6 | 27.6 | v f α'+β |
| 78 | | | | | | | | 5 | | 10.5 | 14 | 7.0 | 25.1 | 32.1 | 28.7 | 25.0 | α'+β |
| 79 | | | | | | | | 5 | | 1.5 | 16 | 1.0 | 12.6 | 13.6 | 32.3 | 35.6 | α' |
| 80 | | | | | | | | 5 | | 3 | 16 | 2.0 | 15.3 | 17.3 | 34.4 | 32.8 | α' |
| 81 | | | | | | | | 5 | | 4.5 | 16 | 3.0 | 17.9 | 20.9 | 41.1 | 34.0 | α' |
| 82 | | | | | | | | 5 | | 7.5 | 16 | 5.0 | 23.3 | 28.3 | 22.7 | 28.8 | α' |
| 83 | | | | | | | | 5 | | 1.5 | 17 | 1.0 | 13.8 | 14.8 | 33.2 | 35.0 | α' |
| 84 | | | | | | | | 5 | | 3 | 17 | 2.0 | 16.5 | 18.5 | 35.3 | 31.4 | α' |
| 85 | | | | | | | | 5 | | 6 | 17 | 4.0 | 22.1 | 26.1 | 39.8 | 30.2 | vv f α' |
| 86 | | | | | | | | 2 | | 12 | 6.5 | 8.0 | 11.3 | 19.3 | 29.6 | 25.7 | β |
| 87 | | | | | | | | 2 | | 10.5 | 3 | 7.0 | 6.9 | 13.9 | 35.8 | 22.4 | α'+β |
| 88 | | 1 | | | | | | 5 | | 5.5 | 7 | 3.0 | 6.9 | 9.9 | | | 1–5% α+α' |
| 89 | | 1 | | | | | | 5 | | 5.5 | 10.5 | 3.7 | 11.2 | 14.9 | 38.2 | 34.6 | α'+β |
| 90 | | 2 | | | | | | 5 | | 11 | 8.5 | 7.4 | 14.0 | 21.4 | 24.9 | 29.1 | 15–25% α'+β |
| 91 | | 2.5 | | | | | | 5 | | 14.5 | 7 | 9.8 | 14.8 | 24.6 | 24.3 | 25.7 | β |
| 92 | | 0.3 | | | | | 2 | 5 | | 1.7 | 10.5 | 3.1 | 11.4 | 14.5 | | | α'+β |
| 93 | | 1 | | | | | | 5 | | 5.5 | 12 | 3.7 | 12.8 | 16.5 | | | α'+β |
| 94 | | 3 | | | | | | 5 | | 16 | 10 | 10.7 | 20.4 | 31.1 | 28.2 | 28.0 | β |
| 95 | | 1 | | | | | | 5 | | 5.5 | 16.5 | 3.7 | 18.6 | 22.3 | 40.6 | 30.3 | 1% α+α'+β |
| 96 | 0.25 | 6 | | | | | | 5 | | 13 | | 8.7 | −4.9 | 3.8 | 29.2 | 39.6 | β+α' |
| 97 | 0.40 | 6 | | | | | | 5 | | 13 | | 8.7 | −4.9 | 3.8 | 36.8 | 36.7 | α+α' |
| 98 | 0.25 | 7 | | | | | | 5 | | 14 | | 9.4 | −6.3 | 3.1 | 36.1 | 36.7 | β+α' |
| 99 | | 6 | | | | | | 5 | | 13 | | 8.7 | −4.9 | 3.8 | 27.5 | 28.7 | β+α' |
| 100 | | | | | | | | 2 | | 11.5 | 10 | 7.7 | 14.5 | 22.2 | 14.3/ 24.4 | 21.8 | β+(α') |
| 101 | | 2 | | | | | | 2 | | 11.5 | 11.3 | 7.7 | 12.1 | 19.8 | 27.8 | 20.4 | β >>α' |
| 102 | | | | | | | | 4 | | 11.5 | 10 | 7.7 | 18.3 | 26.0 | 22.3 | 22.2 | 30% α'+β |
| 103 | | 2 | | | | | | 4 | | 11.5 | 11.3 | 7.7 | 17.6 | 21.5 | 24.7 | 26.6 | β > α' |
| 104 | | | | | | | | 2 | | 12 | 4.5 | 8.0 | 11.1 | 17.1 | 30.9 | 25.8 | β > α' |
| 105 | | 2.1 | | | | | | 2 | | 11.9 | 6 | 8.0 | 6.7 | 14.7 | 23.1 | 28.3 | α'+β |
| 106 | | 5 | | | | | | 12 | | 6 | | 4.0 | −2.3 | 1.7 | 37.9 | 34.8 | α'+β |
| 107 | 0.25 | 5 | | | | | | 12 | | 6 | | 4.0 | −2.3 | 1.7 | 41.1 | 36.9 | <0.5% α+α'+β |
| 108 | | 5 | | | | | | 4 | | 6 | 7.6 | 4.0 | 0.2 | 4.2 | 44.8 | 32.7 | α' |
| 109 | | 1 | | 2 | | | 2.1 | 1 | | | | 7.8 | −0.7 | 7.1 | 35.4 | 46.3 | α+α'+β |
| 110 | | 2 | | 2 | | | 2.1 | 1 | | | | 7.8 | −2.6 | 5.2 | 36.6 | 45.1 | >80% Wid. α |
| 111 | | 3 | | 2 | | | 2.1 | 1 | | | | 7.8 | −4.5 | 3.3 | 38.1 | 38.6 | ~30% α+ (β→α') |
| 112 | | 1 | | 2 | | | 2.1 | 2 | | | | 7.8 | 0.5 | 8.3 | 38.2 | 40.6 | 1–5%α+α'+β |
| 113 | | 2 | | 2 | | | 2.1 | 2 | | | | 7.8 | −1.4 | 6.4 | 36.1 | 45.2 | ~20% α+α' |
| 114 | | 3 | | 2 | | | 2.1 | 2 | | | | 7.8 | −3.3 | 4.5 | 38.4 | 37.8 | 40–50% α+β |
| 115 | | 1 | | 1 | | | 2.2 | 5 | | | | 5.0 | 1.9 | 6.9 | 38.2 | 43.3 | ≤ 5% α+ (β→α') |
| 116 | | 2 | | 1 | | | 2.2 | 5 | | | | 5.0 | 0.0 | 5.0 | 36.9 | 40.3 | ~15% α+ (β→α') |
| 117 | | 3 | | 1 | | | 2.2 | 5 | | | | 5.0 | −1.9 | 3.1 | 39.0 | 36.0 | Wid.~30%α+β |
| 118 | | | | 1 | | | 0.8 | 11 | | | | 3.6 | 5.9 | 9.5 | 37.5 | 44.8 | ~95% α'+β |
| 119 | | 1 | | 1 | | | 0.8 | 11 | | | | 3.6 | 4.0 | 7.6 | 38.7 | 39.5 | ~20% α+ (β→α') |
| 120 | | 2 | | 1 | | | 0.8 | 11 | | | | 3.6 | 2.1 | 5.7 | 38.4 | 34.5 | ~25% α+ (β→α') |
| 121 | | 3 | | 1 | | | 0.8 | 11 | | | | 3.6 | 0.2 | 3.8 | 38.7 | 37.1 | Wid.65% α+β |
| 122 | | | | 2 | | | 2.1 | | | | 1 | 7.8 | 0.9 | 8.7 | 40.3 | 50.6 | ~20% α+(β→α') |
| 123 | | | | 2 | | | 2.1 | | | | 3 | 7.8 | 1.8 | 10.6 | 37.5 | 50.3 | <1% α+(β→α') |
| 124 | | | | 2 | | | 2.1 | | | | 5 | 7.8 | 4.7 | 12.5 | 39.7 | 48.6 | α'(25% very course) |
| 125 | | | | 1 | | | 2.2 | | | | 5 | 5.0 | 3.0 | 8.0 | 38.0 | 47.8 | 1% α+α' |
| 126 | | | | 1 | | | 2.2 | | | | 7 | 5.0 | 4.2 | 9.2 | 34.6 | 42.5 | <5% α+(β→α') |
| 127 | | | | 1 | | | 2.2 | | | | 9 | 5.0 | 2.5 | 7.5 | 37.7 | 46.7 | 1–10%α+ (β→α') |
| 128 | | | | 1 | | | 0.8 | | | | 11 | 3.6 | 4.8 | 8.4 | 32.7 | 41.5 | ~25% α+ (β→α') |
| 129 | | | | 1 | | | 0.8 | | | | 13 | 3.6 | 5.6 | 9.2 | 32.4 | 42.9 | Seg. 5–60% α+ (β→α') |
| 130 | | | | 1 | | | 0.8 | | | | 15 | 3.6 | 6.5 | 10.1 | 36.6 | 45.5 | ~30% α+ (β→α') |
| 131[c] | | 1.4 | | | | | | 5 | | 8 | 11 | 5.3 | 14.3 | 19.6 | 31.2 | | α'+β |
| 101[c] | | 2 | | | | | | 2 | | 11.5 | 11.3 | 7.7 | 12.1 | 19.8 | 22.8 | | β+(α') |
| 132[c] | | | | | | | | 9 | | 11.5 | 2.5 | 7.7 | 12.0 | 19.7 | 26.0 | 22.0 | β+(α') |

*: by x-ray; all others by light optical metallograph
+: also contains 0.05 boron
Wid: Widmanstätten
v: very (α'): submicroscopic martensite
(β→α'): transformation appears incomplete so that some beta probably retained
c: 100 pound - 1 inch plate TABLE VI-continued

| Alloy No. | Composition, weight percent | | | | | | | | | | | | | | Hardness, $R_C$ | | β-AC Microstructure |
|---|---|---|---|---|---|---|---|---|---|---|---|---|---|---|---|---|---|
| | Si | Al | Cu | Fe | Cb | Mn | Mo | Sn | Ta | V | Zr | $B_P$ | $B_S$ | $B_T$ | β-AC | β-WQ | |

f: fine
α': martensite evaluation
Seg.: segregated compositionally
α: alpha phase
β: beta phase
ω: omega phase Alloying elements specifically covered in this investigation were: Cb, Cu, Fe, Mn, Mo, Ta, V, Sn, Zr, B, Si and Al.

The feasibility of the concept of a titanium-base alloy which would: (1) transform martensitically upon being cooled relatively slowly from the beta phase field, and (2) subsequently age to a high strength level was explored by means of the alloys Nos. 1 – 15. In this first group, the alloys were composed to maximize beta stabilization while minimizing supersaturation of the transformation product lattice, which was expected to be hop, i.e., alpha prime. Therefore, a number of beta stabilizing elements were added in amounts not greatly exceeding their alpha solubilities. Tin and zirconium were added for the possibility that they contribute to beta stabilization (based upon the fact that initial additions lower the beta transus) although they have high or complete (in the case of zirconium) solubility in alpha. Aluminum was added to some alloys as a solid solution hardener, and silicon as a dispersion hardener.

Metallography and hardness measurement of the initial group of alloys confirmed that the characteristics sought were indeed obtained; that is, the alloys transformed (at least partially) martensitically and were age hardenable. Also it was discovered that certain of the alloys, Nos. 3 and 7, were unusually soft as air cooled from the beta. This was determined to result from stress induced transformation of beta to martensite, which in turn results in transformation plasticity; thus alloys were discovered which exhibited the unique combination of (1) transformation induced plasticity characteristics as air cooled from the beta, and (2) age hardenability.

In this first group the alloys were highly complex consisting of from seven to nine alloying additions in amounts totaling up to 40 wt pct. The alloys were also of exceptionally high density ranging up to 65 percent heavier than unalloyed titanium. As a start in reducing the alloy density, it was decided to determine which of those additions that were both added in large amount and were also heavier than titanium, were not essential to the development of the desired characteristics. The alloys listed under the second purpose in Table V demonstrated that tantalum was not essential, but that either tin or zirconium was essential.

Efforts to discover the fewest components which would produce the essential embodiments of the instant invention (see Item 2 of Table V) revealed at this stage that two alloying additions were the minimum requirement, a beta stabilizer and either tin or zirconium in amounts inversely related to the amount of primary beta stabilizer. The silicon addition is not essential, as will be shown later.

The desirability of lowest density dictated that the beta stabilizing addition should be selected to have the highest beta stabilizing efficiency (i.e., ratio of specific molybdenum equivalent to density). Reference to Table I shows that iron is the most efficient beta stabilizer. Alloy No. 22, Ti-1Fe-10Zr-0.15Si (refer to Item 4 Table V and to Table VI) had a small amount of primary alpha in its microstructure as air cooled from the beta, indicating that the total beta stabilization, $B_T$ was not high enough. This is verified by alloy No. 26, Ti-1Fe-5Sn-10Zr-0.15Si which had a martensite + beta microstructure, although its content of primary beta stabilizer was identical to that of alloy No. 22. (As-transformed microstructures consisting of martensite and beta almost certainly contain omega as well. However, the presence of omega can be verified only by x-ray or electron diffraction means. Since this could be done for only a selected few compositions, the microstructural description does not include omega unless it was verified by diffraction.) The alloys Nos. 22 and 26 are not considered to be optimum, for reasons that will be discussed below.

Alloying additions evaluated for dispersion hardening were boron, copper and silicon, see Item 5, Table V. It was confirmed that zirconium greatly reduced the solubility of silicon in a Ti-6Al-3Sn-3Zr alloy, compared to silicon solubility in unalloyed titanium. Additions of 0.5 weight percent silicon resulted in large silicide particles precipitated at the beta grain boundaries or prior beta grain boundaries of alloys. As will be shown below, ductility was severely adversely affected by the presence of the silicides. A boron addition of 0.05 wt pct to alloy No. 31, Ti-2Cb-0.3Mo-5Sn-4V-10Zr-0.05B, resulted in a similar microstructure with boride replacing silicide. Copper was potentially a dispersion hardener because of the ease in which the component $Ti_2Cu$ is formed. Its performance in this role will also be discussed later.

All of the alloys investigated played a role in defining the limits of occurrence of the characteristics of this invention. However, one group of alloys were made specifically to help define these limits. These alloys are designated under Item 6 of Table V. The beta parameters, $B_P$ and $B_S$, of selected alloys are plotted in FIG. 2 in order to show the structural relationship between the alloys of this invention and the commercial alloys of titanium. The compositions, beta parameters and patent numbers, where known, of the commercial alloys plotted in FIG. 2 are given in Table VII.

TABLE VII

| Alloy (Composition in weight percent) | Type | Beta $B_P$ | Parameter $B_S$ | Values $B_T$ | U.S. Pat. No. | Issue Date |
|---|---|---|---|---|---|---|
| Ti-8Al-1Mo-1V | α+β | 1.7 | −15.2 | −13.5 | 2,754,204 | 7/10/56 |
| Ti6Al-4V | α+β | 2.7 | −11.4 | −8.7 | 2,754,204 | 7/10/56 |
| Ti-7Al-4Mo | α+β | 4.0 | −13.3 | −9.3 | 2,554,031 | 10/20/49 |

TABLE VII-continued

| Alloy (Composition in weight percent) | Type | Beta $B_P$ | Parameter $B_S$ | Values $B_T$ | U.S. Pat. No. | Issue Date |
|---|---|---|---|---|---|---|
| IMI 700: Ti-4Mo-1Cu-6Al-5Zr-0.5Si | $\alpha+\beta$ | 4.8 | −8.5 | −3.7 | (Commercial alloy) | |
| IMI 680, Ti-4Mo-2.25Al-11Sn-0.5Si | $\alpha+\beta$ | 4.0 | 2.3 | 6.3 | 3,049,425 | 8/14/62 |
| IMI 679, Ti-1Mo-2.25Al-11Sn-5Zr-0.3Si | $\alpha+\beta$ | 1.0 | 4.0 | 5.0 | 3,049,425 | 8/14/62 |
| Ti-8V-8Mo-2Fe-3Al | $\beta$ | 19.1 | −5.7 | 13.4 | (TMCA Developmental) | |
| Ti-8V-5Fe-1Al | $\beta$ | 19.6 | −1.9 | 17.1 | 2,819,959 | 1/14/58 |
| Ti-13V-11Cr-3Al | $\beta$ | 26.3 | −5.7 | 20.6 | 3,147,115 | 9/1/64 |
| Beta III, Ti-11.5Mo-6Zr-4.5Sn | $\beta$ | 11.5 | 19.5 | 31.0 | (Crucible Steel Developmental) | |
| Ti-25V-5Sn-3Al | $\beta$ | 16.7 | 6.8 | 23.5 | 2,754,203 | 7/10/56 |
| Ti-6Al-6V-2Sn-0.7Fe-0.7Cu | $\alpha+\beta$ | 6.5 | −9.4 | −2.9 | 3,069,259 | 12/18/62 |
| Ti-7Mn | $\alpha+\beta$ | 10.9 | 0.0 | 10.9 | 2,704,251 | 3/15/55 |
| Ti-16V-2.5Al | $\alpha+\beta$ | 10.7 | −4.7 | 6.0 | (Commercial alloy) | |
| Beta II, Ti-12Mo-6Sn | $\beta$ | 12.0 | 10.8 | 22.8 | 3,269,825 | 8/30/66 |
| Ti-5Sn-10Cr, Ti-15Sn-10Cr Ti-5Sn-10Cr-5Fe, Ti-15Sn-10Cr-5Fe (preferred compositions of patent) | $\beta$ | 15.9−35.8 | 11.9−67.7 | 27.8−103.5 | 2,797,996 | 7/2/57 |
| Ti-3Al-8V-6Cr-4Mo-4Zr | $\beta$ | 18.9 | 3.4 | 22.3 | (Reactive Metals, Inc. Developmental) | |

The generalized structural diagram FIG. 2 is based upon air cooling sheet material of about ⅛-inch thickness from above the beta/alpha + beta transus temperature. In general as $B_P$ increases the Ms temperature decreases, and falls to room temperature at $B_P = 10$, $B_S = 0$; and as $B_P$ and $B_S$ increase, hardenability increases.

From the standpoint of creep strength-to-density ratio, aluminum is most effective single addition to titanium. Of the alloying additions investigated, aluminum is unique in that it promotes rather than retards the formation of primary alpha. Therefore, considering the region below $B_P = 10$, as the amount of this "negative secondary beta stabilizer" is increased the $B_S$ parameter becomes smaller or more negative, assuming all other factors were held constant. Finally, hardenability is reduced to the point that full transformation to Widmanstatten alpha + beta results from air cooling as in the case of the commercial alloys Ti-6Al-4V, Ti-8Al-1Mo-1V, IMI 700, and Ti-6Al-6V-2Sn-Fe-Cu. Between the region in which these commercial alloys lie and that of the alloys with complete characteristics of the alloys of this invention, there is a region of mixed microstructures varying between the two extremes. A primary factor in the microstructural variation is whether the alloys contain tin and zirconium in combination and therefore reflect compounding of their hardenability effects, compared with alloys that contain either tin or zirconium. The amount of aluminum present in relation to other alloying additions also has significant influence in this structurally mixed region. For example, alloy No. 108, Ti-6V-5Al-6Sn-7.6Zr ($B_P = 4$, $B_S = 0.2$, $B_T = 4.2$) was essentially a martensitic structure containing no primary alpha; while alloy No. 121, Ti-1Fe-0.8 Mo-3Al - 11Sn ($B_P = 3.6$, $B_S = 0.2$, $B_T = 3.8$) was Widmanstätten alpha + beta.

The region of FIG. 2 of primary interest to the instant invention is bounded by $B_P$ values from 5.0 to 10.5 and $B_S$ values from 4 to 26. This region is outlined in broken lines in FIG. 2. The preferred region of interest is bounded in solid lines by $B_P$ from 6.0 to 9.0 and $B_S$ from 6.0 to 20.5. Successive improvement is noted as the $B_P$ values change from 5.0 to 5.2 to 5.5 to 6.0 in lower region and from 10.5 to 10.0 to 9 in the upper range. Similar improvement is noted in $B_S$ values as they change from this broad range to the narrow range. FIG. 2 clearly shows the distinction between commercial, developmental and other titanium-base alloys and the alloys of the instant invention. Thus, the prior art teaches the making of alpha, near alpha, alpha + beta, or metastable beta alloys; while the instant invention teaches the art of making high-hardenability martensite + beta alloys.

Items 7–9 of Table V give the alloys made in order to determine the molybdenum equivalent of the alloying additions; tin, zirconium and aluminum. These determinations have been discussed above. A primary consideration in optimization was the selection of a primary beta stabilizer from those available. The isomorphous beta stabilizers (columbium, molybdenum, tantalum and vanadium) are preferable to the eutectoid group (including such elements as chromium, iron manganese, nickel and copper). This follows from their being less prone to cause segregation problems in large ingots, and from the fact they produce alloys of inherently greater stability, because they do not form intermetallic compounds with titanium. Of the isomorphous group, vanadium is given preference, for it has the highest beta stabilizing efficiency (see Table I). It has the additional advantages of having the lowest density and the lowest melting point of the group. The last two factors are important in achieving homogeneity in large ingots.

Figure 3:
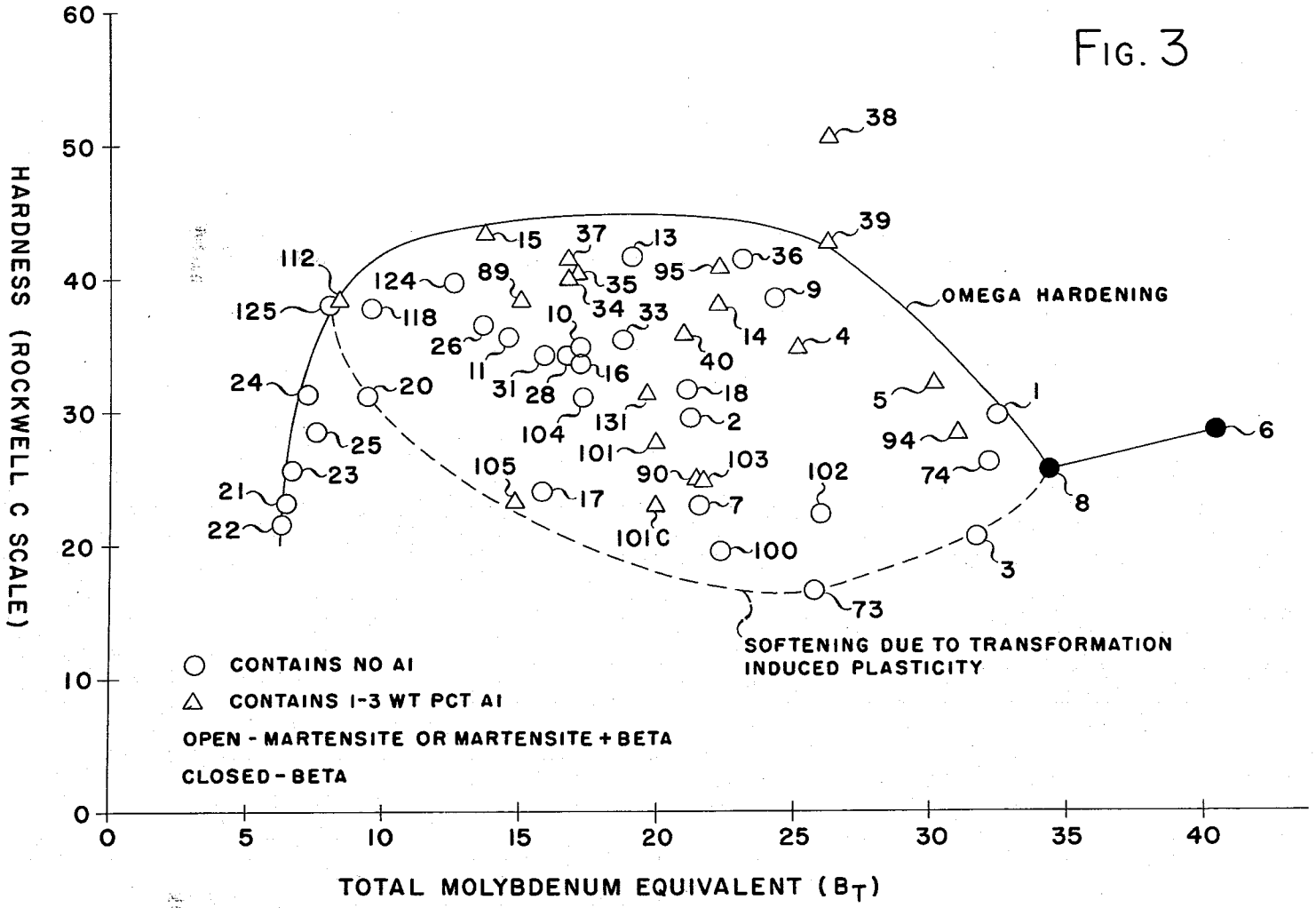
FIG. 3 is a graph plotting the hardness of various air-cooled titanium alloys against $B_T$, as defined below.
Figure 4:
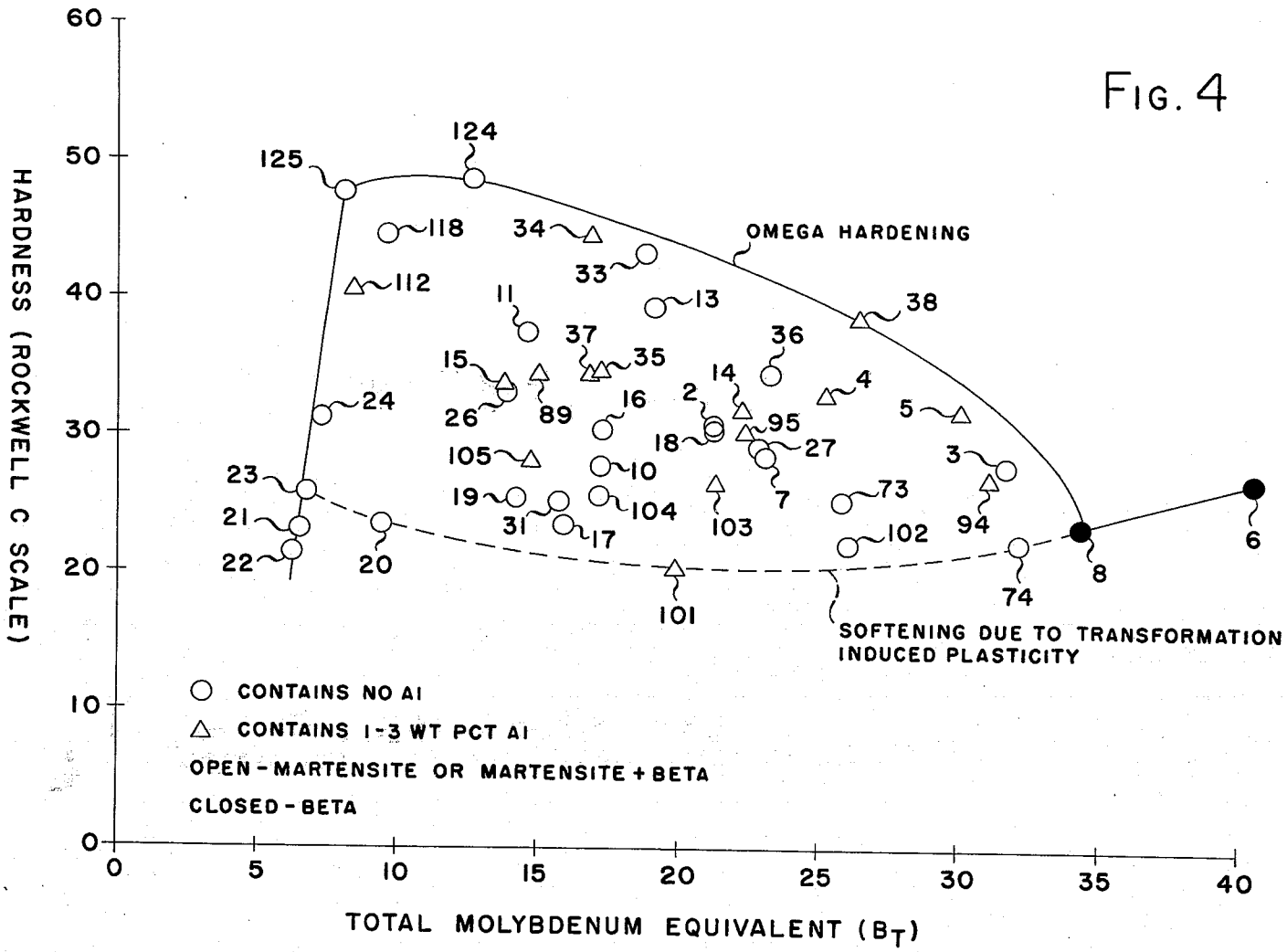
FIG. 4 is a graph similar to FIG. 3 for water-cooled titanium alloys.

A plot of hardness versus total beta stabilization, $B_T$, provides a useful guide for selection of alloys expected to have good weldability. Such plots are shown in FIG. 3 for air-cooled alloys and in FIG. 4 water-quenched alloys, both cooled from the beta phase field. Data plotted in FIG. 3 are for alloys varying in microstructure from alpha (less than 5%) + martensite to all beta. At the lower end of the $B_T$ scale alloys are soft as air cooled and as water quenched from the beta. Such alloys would be expected to have good weldability as shrinkage and thermal stresses could be readily relieved by plastic flow. As $B_T$ increases, hardness increases markedly, due to the occurrence of increasing amounts of omega phase. At still higher values of $B_T$, beta stabilization is sufficient to prevent omega from being formed and hardness drops. The range where omega hardening is encountered has considerable scatter in hardness because of an off-setting softening mechanism. This is phase transformation induced by stress or strain as discussed above. Thus it can be seen that alloys having the same $B_T$ can vary widely in their susceptibility to transformation induced plasticity, depending upon specific composition. Furthermore, as shown below, alloys having identical values of $B_P$ and $B_S$ may have markedly different susceptibilities to transformation-induced plasticity, due to a rather subtle variation in composition.

Alloys exhibiting the characteristic of transformation-induced plasticity are considered to have the best weldability since through this mechanism plastic flow can occur at stress levels far below the yield strength (in the absence of this mechanism). Pronounced transformation-induced plasticity characteristics occur in the $B_T$ range from 12 to 33. Within this range, alloy composition must be carefully selected to produce the optimum combination of properties in the aged condition as well as properly balanced transformation-induced plasticity characteristics. If the latter mechanism is too easily triggered, then a slight amount of deformation may use up all of the potential of the alloy for transformation-induced plasticity. In some alloys, stresses induced by rapid cooling (e.g. water quenching) may be sufficient to transform substantial amounts of beta leaving little to provide for plastic flow through the mechanism of transformation-induced plasticity. Ideally, this mechanism should occur relatively slowly over a large strain range rather than all at once. Also, for ideal weldability, it is considered that the hardness of the alloy should not exceed Rockwell C 30 either as air-cooled or water-quenched from the beta phase field.

Since both martensite and the retained beta are metastable phases, both are capable of aging. Titanium martensite conventionally called "alpha prime" tempers by precipitating beta. This martensite is hcp; however, some call it "alpha double prime" and call a fcc or fct martensite which they observed "alpha prime." The martensite occurring in the alloys of this invention is hep, and, therefore, it is presumed that it ages by precipitating alpha. Alloys having $B_P$ values of 4 ore more combined with $B_S$ values of about 6 or more, may appear to be all beta under the light microscope. This is apparently due to the fact that the martensite is submicroscopic. Upon heating, the martensite phase initially grows rather rapidly and then ages. Submicroscopic martensite becomes microscopic upon heating to 1000° F or more. At temperatures between 1000° F and the beta transus, the martensite appears to age preferentially, followed by aging of the beta phase. In the temperature range from 900° to 1000° F the coarsened martensite and beta age at approximatey the same rate. The exact temperature of simultaneous aging of the martensite and beta appears to depend upon composition. Aging at 800° F appears to cause very slow coarsening of the martensite, and preferential aging of the beta. Maximum strength levels are produced in the range where beta ages preferentially. As a consequence maximum strength depends upon exceeding some minimum level of retained beta.

Three basic types of heat treatments are feasible for the alloys of this invention: (1) air or water quench from the beta phase and age (analogous to conventional beta alloys such as Ti-13V-11Cr-3Al); (2) solution treatment within 400° F below the beta transus to coarsen the martensite, and age at a lower temperature (analogous to heat treatment of conventional alpha-beta alloys); and (3) isothermal transformation by quenching from the beta phase to the aging temperature. This third heat treatment is not presently used in titanium practice.

Tensile properties of selected alloys covering a wide spectrum of compositions and beta parameters are given in Table VIII. The data are for 0.07-inch thick specimens machined from ⅛-inch sheet and includes specimens having a double bead weldment transverse to the stress axis.

TABLE VIII

| Alloy No. | $B_P/B_S$ | Metal | Cooling Rate | Aging Treatment Temp,° F | Aging Treatment Time, hr. | Fty Ksi | Ftu Ksi | Elong. pct. | Notched Ftu/Ftu $K_t = 5$ | Microstructure |
|---|---|---|---|---|---|---|---|---|---|---|
| 2 | 5.3/15.8 | Base | AC | None | | 78 | 137 | 13 | | $\alpha'+\beta$ |
| | | " | WA | 800 | 4 176 | 195 | 2 | | | |
| | | Weld | AC | None | | 57 | 132 | 5 | | |
| | | Weld | WA | 800 | 4 | | 152 | 0 | | |
| | Composition: Ti - 3 Cb - 0.3 Mo - 13Ta - 2V-5 Sn - 10 Zr - 0.5 Si | | | | | | | | | |
| 7 | 8.0/15.0 | Base | WA | None | | 58 | 111 | 11 | | $\alpha'+\beta$ |
| | | " | AC | 800 | 2 | — | 152 | 0 | | |
| | | Weld | AC | None | | 51 | 80 | 4 | | |
| | | " | WA | 800 | 2 | 116 | 130 | 0.3 | | |
| | Composition: Ti - 3 Cb - 0.3 Mo - 0.3 Mn - 20 Ta - 2V - 5 Sn - 10 Zr - 1Si | | | | | | | | | |
| 8 | 9.8/24.5 | Base | AC | None | | 91 | 101 | 8 | | $\beta$ |
| | | | AC | 900 | 24 | 170 | 178 | >0.4,<1 | | |
| | Composition: Ti - 3 Cb - 1Mn - 1 Mo - 20 Ta - 3V - 5 Sn - 10 Zr | | | | | | | | | |
| 11 | 3.2/11.8 | Base | WA | None | | 104 | 142 | 11 | | $\alpha'+\beta$ |
| | | Base | WA | 800 | 4 | 156 | 162 | 0.5 | | |
| | | Weld | AC | None | | 73 | 101 | 2 | | |
| | | Weld | AC | 900 | 1 | 155 | 160 | 0.5 | | |
| | Composition: Ti - 2Cb-0.3 Mo - 10Ta - 5 Sn - 10 Zr - 0.5 Si | | | | | | | | | |
| 12 | 5.3/15.8 | Base | AC | None | | 154 | 155 | 0.2 | | $\alpha'+\beta$ |
| | | Base | AC | 900 | 24 | 183 | 189 | 1 | | |
| | | Base | WA | 800 | 4 | 183 | 192 | 1.5 | | |
| | | Weld | AC | None | | 86 | 139 | 4 | | |
| | | WA | 900 | 24 | — | 164 | 0 | | | |
| | Composition: Ti - 2 Cb - 2 Cu - 0.3 Mo - 10Ta - 1V-5 Sn - 10 Zr-0.5Si | | | | | | | | | |
| 13 | 4.6/14.4 | Base | AC | None | | 128 | 160 | 2 | | $\alpha'+\beta$ |
| | | Base | WA | None | | 106 | 151 | 3 | | |
| | | Base | WA | 800 | 4 | 175 | 191 | 2 | | |
| | Composition: Ti-2Cb-2Cu-0.3 Mo-10Ta - 5 Sn - 10Zr - 0.5Si | | | | | | | | | |
| 15 | 4.7/8.9 | Base | WA | 800 | 4 | 192 | 203 | 1 | | $\alpha'+\beta$ |
| | Composition: Ti-3Cb-0.3 Mo-10Ta-2V-3Al-5Sn-10Zr-0.5Si | | | | | | | | | |
| 22 | 2.8/3.4 | Base | AC | None | | 72 | 106 | 12 | | $\alpha+\alpha'$ |
| | | Base | AC | 900 | 24 | 81 | 106 | 20 | 1.25 | |
| | | Weld | AC | None | | 86 | 108 | 10 | | |
| | | Weld | AC | 900 | 24 | 100 | 112 | 8 | | |
| | Composition: Ti-1Fe-10Zr-0.15 Si | | | | | | | | | |
| 23 | 3.0/3.6 | Base | AC | None | | 88 | 120 | 12 | | $\alpha+\alpha'$ |

TABLE VIII-continued

| Alloy No. | $B_p/B_s$ | Metal | Cooling Rate | Aging Treatment Temp,° F | Aging Treatment Time, hr. | Fty Ksi | Ftu Ksi | Elong. pct. | Notched Ftu/Ftu $K_t = 5$ | Microstructure |
|---|---|---|---|---|---|---|---|---|---|---|
| | | Base | AC | 900 | 24 | 94 | 119 | 14 | 1.29 | |
| | | Weld | AC | None | | 94 | 118 | 12 | | |
| | | Weld | AC | 900 | 24 | 102 | 119 | 8 | | |
| | Composition: Ti-3Mo-10Zr-0.15Si | | | | | | | | | |
| 25 | 3.0/4.5 | Base | AC | None | | 86 | 118 | 14 | | $\alpha+\beta$ |
| | | | AC | 900 | 24 | 94 | 119 | 12 | 1.26 | |
| | | Weld | AC | None | | 107 | 122 | 8 | | |
| | | | AC | 900 | 24 | 108 | 118 | 4 | | |
| | Composition: Ti-3Mo-10Sn-0.15Si | | | | | | | | | |
| 28 | 3.8/12.9 | Base | AC | None | | 103 | 138 | 8 | | $\alpha'+\beta$ |
| | | | AC | 900 | 24 | 119 | 142 | 10 | 1.20 | |
| | | Weld | AC | None | | 112 | 132 | 4 | | |
| | | | AC | 900 | 24 | — | 132 | 4 | | |
| | Composition: Ti-2Cb-0.3Mo-4Ta-3V-5Sn-10Zr-0.1Si | | | | | | | | | |
| 29 | 3.8/12.9 | Base | AC | None | | 96 | 139 | 4 | | $\alpha'+\beta$ |
| | | | AC | 900 | 24 | 117 | 143 | 9 | | |
| | | Weld | AC | None | | 96 | 133 | 6 | | |
| | | | AC | 900 | 24 | 128 | 132 | 4 | | |
| | Composition: Ti-2Cb-0.3Mo-4Ta-3V-5Sn-10Zr - 0.2Si | | | | | | | | | |
| 30 | 3.8/12.9 | Base | AC | None | | 107 | 143 | 6 | | $\alpha'+\beta$ |
| | | | AC | 900 | 24 | 109 | 137 | 5 | | |
| | | Weld | AC | None | | 102 | 133 | 4 | | |
| | | | AC | 900 | 24 | — | 126 | 0 | | |
| | Composition: Ti-2Cb-0.3Mo-4Ta-3V-5Sn-10Zr-0.3Si | | | | | | | | | |
| 32 | 3.8/12.9 | Base | AC | None | | 82 | 125 | 13 | | $\alpha+\alpha'$ |
| | | | AC | 900 | 24 | 97 | 126 | 5 | | |
| | | Weld | AC | None | | 106 | 126 | 6 | | |
| | | | AC | 900 | 24 | 108 | 121 | 4 | | |
| | Composition: Ti-1Fe-1Mo-5Sn-10Zr-0.15Si | | | | | | | | | |
| 33 | 4.5/14.2 | Base | AC | None | | 78 | 128 | 10 | | $\alpha'+\beta$ |
| | | | AC | 800 | 4 | 101 | 138 | 10 | | |
| | Composition: Ti-1Fe-1Mo-1V-5Sn-10Zr-0.15Si | | | | | | | | | |
| 34 | 4.5/12.3 | Base | AC | None | | 104 | 140 | 10 | | $\alpha'+\beta$ |
| | | | AC | 800 | 4 | 116 | 149 | 8 | | |
| | Composition: Ti-1Fe-1Mo-1V-1Al-5Sn-10Zr-0.15Si | | | | | | | | | |
| 35 | 5.2/11.8 | Base | AC | None | | 129 | 154 | 8 | | $\alpha'$ |
| | | | AC | 900 | 24 | 132 | 158 | 2 | 1.06 | |
| | Composition: Ti-1Fe-1Mo-2V-2Al-5Sn-10Zr-0.15Si | | | | | | | | | |
| 36 | 6.0/17.1 | Base | AC | None | | 108 | 145 | 7 | | $\alpha'$ |
| | | | AC | 800 | 4 | 120 | 133 | >0.2,<1 | | |
| | Composition: Ti-1Cu-1Fe-1Mo-2V-5Sn-10Zr-0.15Si | | | | | | | | | |
| 38 | 9.0/17.3 | Base | AC | None | | 179 | 210 | 0.2, 1 | | $\alpha'+\beta$ |
| | | | AC | 800 | 4 | | 156 | 0 | | |
| | Composition: Ti-5Cu-1Fe-1Mo-2V-3Al-5Sn-10Zr-0.15Si | | | | | | | | | |
| 41 | 6.2/7.4 | Base | AC | None | | 113 | 147 | 8 | | $\alpha'$Pearlite |
| | | | AC | 800 | 4 | 118 | 144 | 12 | 1.15 | |
| | | Weld | AC | None | | 127 | 143 | >0.5,<1 | | |
| | | | AC | 900 | 24 | 114 | 130 | >0.4,<1 | | |
| | Composition: Ti-8Cu-10Zr | | | | | | | | | |
| 89 | 3.7/11.2 | Base | AC | None | | 126 | 175 | 4 | | $\alpha'+\beta$ |
| | | | AC | 900 | 24 | 154 | 170 | 4 | | |
| | Composition: Ti-5.5V-1Al-5Sn-10.5Zr | | | | | | | | | |
| 90 | 7.4/14.0 | Base | AC | | | 94 | 108 | 16 | | $\beta+\alpha'$ |
| | | | AC | 800/1000 | | 4/12 | 178 | 181 | | 0.3 |
| | Composition: Ti-11V-2Al-5Sn-8.5Zr | | | | | | | | | |
| 91 | 9.8/14.8 | Base | AC | None | | 91 | 105 | 16 | | $\beta$ |
| | | | AC | 800/1000 | 4/12 | | 153 | 0 | | |
| | Composition: Ti-14.5V-2.5Al-5Sn-7Zr | | | | | | | | | |
| 94 | 10.7/20.4 | Base | AC | None | | 117 | 129 | 14 | | $\beta$ |
| | | | AC | 800/1000 | 4/12 | | 148 | 0 | | |
| | Composition: Ti-16V-3Al-5Sn-10Zr | | | | | | | | | |
| 95 | 3.7/18.6 | Base | AC | None | | 126 | 163 | 4 | | 1%$\alpha+\alpha'\beta$ |
| | | | AC | 800/1000 4/12 | | 144 | 161 | 0.5 | | |
| | Composition: Ti-5.5V-1Al-5Sn-16.5Zr | | | | | | | | | |
| 100 | 7.7/14.5 | Base | AC | None | | 101 | 116 | 4 | | $\beta+\alpha'$ |
| | | | AC | 800/1000 4/12 | | 110 | 122 | 10 | | |
| | | | AC | 800/1100 48/¼ | | 123 | 137 | 6 | | |
| | Composition: Ti-11.5V-2Sn-10Zr | | | | | | | | | |
| 101 | 7.7/12.1 | Base | AC | None | | 88 | 109 | 16 | | $\beta+\alpha'$ |
| | | | AC | 1100/800/1/48 1100 ¼ | | 147 | 159 | 3 | | |
| | Composition: Ti-11.5V-2Al-2Sn-11.3Zr | | | | | | | | | |
| 102 | 7.7/18.3 | Base | AC | None | | 74 | 110 | 30 | | $\beta+\alpha'$ |
| | | | AC | 1100/800/1/48 1100 ¼ | | 117 | 130 | 4 | | |
| | Composition: Ti-11.5V-4 Sn-10Zr | | | | | | | | | |
| 103 | 7.7/17.6 | Base | AC | None | | 91 | 103 | 14 | | $\beta+\alpha'$ |
| | | | AC | 800/1000 4/12 | | 178 | 181 | 0.3 | | |
| | Composition: Ti-11.5V-2Al-4Sn-11.3Zr | | | | | | | | | |
| 104 | 8.0/11.1 | Base | AC | None | | 98 | 99 | <1 | | $\beta+\alpha'$ |
| | | | AC | 800/1000 4/12 | | 124 | 141 | 10 | | |
| | Composition: Ti-12V-2Sn-4.5 Zr | | | | | | | | | |
| 105 | 8.0/6.7 | Base | AC | None | | 44 | 111 | 20 | | $\beta+\alpha'$ |
| | | | AC | 1000 | 48 | 160 | 170 | 7 | | |

TABLE VIII-continued

| Alloy No. | $B_P/B_S$ | Metal | Cooling Rate | Aging Treatment Temp,° F | Aging Treatment Time, hr. | Fty Ksi | Ftu Ksi | Elong. pct. | Notched Ftu/Ftu $K_t = 5$ | Microstructure |
|---|---|---|---|---|---|---|---|---|---|---|
| Composition: Ti-11.9V-2.1Al-2Sn-6 Zr. | | | | | | | | | | |

Several significant facts emerge from these data. The martensite plus beta alloys have yield-to-ultimate-strength ratios much lower than that of commercial alloys in the annealed condition. For example, alloy No. 7 has a yield: ultimate ratio of 0.5 compared to values of 0.8 to 0.96 for commercial alloys. These remarkably low ratios are due to the occurrence of stress induced transformation — the characteristic discussed above.

The first group of alloys evaluated demonstrated the capacity of the alloys to age harden. However, these alloys were of low ductility in the aged condition due to the 0.5 or 1 weight per cent silicon addition which produced large silicide particles in grain boundaries. Silicon is particularly detrimental to weldments due, apparently, to concentration of silicide at the base metal/weld metal interface. The data for alloys Nos. 28 through 30, which differ compositionally only in silicon content, demonstrate the deterioration of ductility that results from raising the silicon content progressively from 0.1 to 0.3 weight per cent. It is clear that ductility is good in the as-welded condition. When silicon was reduced to 0.15 weight per cent, weldments exhibited good ductility in the aged condition as well — see data for alloys Nos. 22 through 29. For the most part, alloys having $B_P$ values of 3 (i.e., alloys Nos. 22 – 25) exhibited small responses to aging; while alloys having $B_P$ values of 4 or more showed excellent hardening response upon aging. These observations reflect the importance of beta as the critical age hardening phase in these alloys. The optimum value of $B_P$ for low yield strength in the annealed state combined with high aging response appears to be in the range from 6 to 9.

Alloys Nos. 33 and 34 differ only in that the latter has 1 weight per cent aluminum, while the former is aluminum free. Comparison of their tensile properties shows that the specific influence of aluminum in the alloys of this invention is much greater than its solid-solution hardening effect in binary alloys. The alloy containing the 1 weight per cent aluminum addition is 26,000 psi and 15,000 psi higher in yield strength in the annealed and aged conditions, respectively. In comparison, the specific strengthening effect of aluminum in binary alloys is only 6000 psi per weight per cent of aluminum.

The data for alloys Nos. 89 through 105 represent the initial evaluation of the system Ti-V-Al-Sn-Zr and Ti-V-Sn-Zr. As a result of the studies to determine which alloying additions were essential to develop the characteristics discussed above and as the result of considerations such as beta stabilizing efficiency (see Table I) and tendencies towards segregation in melting, these systems were considered to be the most promising. Comparison of the aging response of the alloys of the two systems, led to the selection of the Ti-V-Al-Sn-Zr system as being optimum. The small size (200 grams) of the experimental ingots did not permit sufficient study of the relationship between heat treatment, strength and ductility needed because of the very different and complex aging behavior of the alloys of this invention compared to conventional titanium alloys. Of this group the best combination of tensile properties was exhibited by alloy No. 105, Ti-11.9V-2.1Al-2Sn-6Zr, aged at 1000° F for 48 hours: 160,000 psi yield strength, 170,000 psi ultimate, and 7 per cent elongation.

Study of all of the data led to the selection for scale-up of two alloys having martensite-to-beta ratios and hardenabilities approximating those of alloys Nos. 2 and 7 but in the Ti-V-Al-Sn-Zr system rather than the Ti-Cb-Mo-Ta-V-Sn-Zr-Si system of alloy No. 2 or the Ti-Cb-Mn-Mo-Ta-V-Sn-Zr-Si system of alloy No. 7. In essence, the primary beta stabilizers of alloys Nos. 2 and 7 were replaced by a single one, vanadium, silicon was eliminated, and aluminum was added. The amount of vanadium required was determined to have the same molybdenum equivalent as the prototype alloys. The tin additions were unchanged and the zirconium additions were increased somewhat to compensate for the negative effects on hardenability of aluminum. Also, a second version of alloy No. 7 in the Ti-V-Al-Sn-Zr system was made with the roles of tin and zirconium reversed since they are interchangeable in the ratio: 1 part zirconium is equivalent to 0.8 part tin. The resulting alloys for scale-up had the compositions: Ti-7.9V-1.4Al-5Sn-11Zr (No. 131), Ti-11.5V-2Al-2Sn-11.3Zr (No. 101), and Ti-11.5V-2Al-9Sn-2.5Zr (No. 132). Mechanical properties of these alloys determined from 100-pound, 1-inch thick plates are summarized in Tables IX, X and XI.

TABLE IX

| ALLOY NO. 131 | | | | | | | | |
|---|---|---|---|---|---|---|---|---|
| Temp. F | Aging Time, hr | Temp. F | Time, hr | Fty ksi | Ftu ksi | Elong. pct | Reduction In Area pct | Hardness Rockwell C Scale |
| SOLUTION TREATMENT: 1450° F for ½ HR - AC to 1000° F - WQ | | | | | | | | |
| None | | | | 50 | 150 | 9 | 8.7 | 31.2 |
| 1100 | 96 | | | 128 | 137 | 6 | 6.5 | 30.8 |
| 1050 | 96* | | | 133 | 139 | 6 | 9.2 | 33.0 |
| 1000 | 192 | | | 149 | 155 | 3 | 3.9 | 35.4 |
| 900 | 96 | | | 196 | 204 | 1 | 5.9 | 42.0 |
| 800 | 192 | | | 225 | 225 | 0.2 | 0.2 | 43.5 |
| 800 | 96 | 1100 | ¼ | 187 | 189 | 0.4 | 1.4 | — |
| SOLUTION TREATMENT: 1300° F for 24 HR - AC | | | | | | | | |
| 900 | 192 | | | 156 | 168 | 3 | 4.3 | 40.3 |
| 800 | 192 | | | 166 | 190 | 1 | 1.7 | 43.7 |
| 0 | | | | | | | | |
| ISOTHERMAL TRANSFORMATION FROM 1450° F - ½HR | | | | | | | | |

TABLE IX-continued

ALLOY NO. 131

| Temp. F | Aging Time, hr | Temp. F | Time, hr | Fty ksi | Ftu ksi | Elong. pct | Reduction In Area pct | Hardness Rockwell C Scale |
|---|---|---|---|---|---|---|---|---|
| 1200 | 24 | | | 74 | 125 | 15 | 25.3 | 29.9 |
| 1100 | 96* | | | 119 | 131 | 9 | 12.0 | 30.7 |
| 1050 | 96 | | | 122 | 156 | 10 | 20.9 | 32.6 |
| 1000 | 96 | | | 128 | 141 | 9 | 20.6 | 34.1 |
| 950 | 8 | | | 130 | 146 | 14 | 34.0 | 34.6 |

*Average for two tests

TABLE X

ALLOY NO. 101

| Temp. F | Aging Time, hr | Temp. F | Time, hr | Fty ksi | Ftu ksi | Elong. pct | Reduction In Area pct | Hardness Rockwell C Scale |
|---|---|---|---|---|---|---|---|---|
| SOLUTION TREATMENT: 1400° F or 1450° F for ½ HR - AC to 1000°F - WQ | | | | | | | | |
| None | | | | 32 | 124 | 19 | 44.5 | 22.8 |
| 1300 | 24* | | | 22 | 123 | 16 | 40.5 | 19.2 |
| 1100 | 48 | | | 124 | 137 | 9 | 23.2 | |
| 1000 | 4 | | | 177 | 186 | 6 | 15.1 | 42.0 |
| 1000 | 48 | | | 167 | 180 | 6 | 13.2 | 40.8 |
| 1000 | 4 | 900 | 48 | 187 | 197 | 6 | 16.0 | 45.1 |
| 1000 | 4 | 900 | 96 | 181 | 191 | 6 | 16.5 | 41.6 |
| 950 | 24 | | | 187 | 198 | 4 | 9.8 | 43.3 |
| 950 | 48 | | | 188 | 196 | 4 | 11.5 | 43.5 |
| 950 | 96* | | | 186 | 194 | 5 | 10.7 | 42.3 |
| 900 | 48 | | | 192 | 197 | 5 | 6.6 | — |
| 900 | 96+ | | | 189 | 198 | 3 | 6.4 | 43.4 |
| 800 | 96 | 1100 | ¼ | 185 | 189 | 3 | 4.9 | 42.5 |
| SOLUTION TREATMENT: 1250° F for 48 HR - AC | | | | | | | | |
| 1000 | 96 | | | 130 | 140 | 11 | 30.4 | 32.6 |
| 900 | 192 | | | 163 | 175 | 8 | 19.8 | 40.1 |
| 800 | 192 | | | 198 | 215 | 2 | 2.2 | 44.3 |
| SOLUTION TREATMENT: 1250° F for 2 HR - AC | | | | | | | | |
| 900 | 48 | | | 170 | 182 | 9 | 25.9 | 41.9 |
| 800 | 48 | | | 197 | 214 | 4 | 3.8 | 46.2 |
| 800 | 96 | | | 181 | 203 | 6 | 11.3 | 45.0 |
| ISOTHERMAL TRANSFORMATION FROM 1400° F or 1450° F | | | | | | | | |
| 1000 | 8 | | | 139 | 149 | 13 | 35.5 | 35.5 |
| 1000 | 24* | | | 148 | 155 | 8 | 22.7 | 36.2 |
| 1000 | 4 | 900 | 96 | 150 | 162 | 12 | 36.0 | 38.7 |
| 950 | 8 | | | 143 | 154 | 13 | 39.4 | 37.2 |
| 950 | 24 | | | 160 | 168 | 10 | 20.9 | 35.8 |
| 950 | 48 | | | 157 | 170 | 8 | 22.3 | 39.6 |
| 900 | 8 | | | 160 | 172 | 10 | 27.8 | 40.6 |
| 900 | 24 | | | 168 | 177 | 6 | 19.9 | 38.8 |
| 800 | 8 | | | 174 | 191 | 4 | 18.0 | 43.3 |
| 800 | 24 | | | 160 | 177 | 8 | 22.4 | 41.7 |
| 700 | 8 | | | 171 | 196 | 5 | 10.4 | 44.1 |
| 700 | 24 | | | 177 | 200 | 4 | 16.2 | 44.4 |
| 700 | 48 | | | 204 | 220 | 4 | 5.5 | 46.5 |

*Solution treatment or isothermally transformed from 1450° F.
+Average for two tests.

TABLE XI

ALLOY NO. 132

| Temp. F | Aging Time, hr | Temp. F | Time, hr | Fty ksi | Ftu ksi | Elong. pct | Reduction In Area pct | Hardness Rockwell C Scale |
|---|---|---|---|---|---|---|---|---|
| SOLUTION TREATMENT: 1475° F for ½ HR - AC to 1100° F - WQ | | | | | | | | |
| None | | | | 92 | 110 | 17 | 33.5 | 27.5 |
| 1000 | 4 | | | 179 | 189 | 6 | 8.7 | 43.6 |
| 1000 | 24 | | | 179 | 189 | 6 | 14.2 | 43.0 |
| 950 | 24 | | | 190 | 202 | 4 | 10.3 | 42.4 |
| 950 | 48 | | | 194 | 202 | 4 | 4.4 | 44.6 |
| 900 | 48 | | | 199 | 213 | 4 | 6.0 | 44.5 |
| 800 | 48 | 950 | 1 | 216 | 221 | 1 | 0.8 | 46.3 |
| SOLUTION TREATMENT: 1250° F for 2 HR - AC | | | | | | | | |
| 900 | 48 | | | 169 | 181 | 7 | 14.4 | 40.0 |
| 800 | 48 | | | 188 | 201 | 7 | 14.9 | 43.2 |
| ISOTHERMALLY TRANSFORMED FROM 1475° F - ½ HR | | | | | | | | |
| 1000 | 8 | | | 169 | 180 | 8 | 18.0 | 41.2 |
| 950 | 8 | | | 181 | 194 | 5 | 12.5 | 45.0 |
| 950 | 24 | | | 190 | 201 | 6 | 12.5 | 40.9 |
| 900 | 8 | | | 197 | 212 | 4 | 9.1 | 44.9 |

TABLE XI-continued

| ALLOY NO. 132 | | | | | | | | |
|---|---|---|---|---|---|---|---|---|
| Temp. F | Aging Time, hr | Temp. F | Time, hr | Fty ksi | Ftu ksi | Elong. pct | Reduction In Area pct | Hardness Rockwell C Scale |
| 900 | 24 | | | 197 | 206 | 5 | 8.3 | 42.9 |

All three alloys evaluated as 100-pound plates exhibited exceptional tensile properties. All demonstrated strength capabilities in excess of 200,000 psi. This strength capability is all the more exceptional in that it obtained in 1-inch thick plates, and the associated heat treatments did not involve rapid quenching from the solution treatment temperatures. In fact, alloys No. 101, Ti-11.5V-2Al-2Sn-11.3Zr, and No. 132, Ti-11.5V-2Al-9Sn-2.5Zr, attained strengths in excess of 200,000 psi through isothermal transformations from beta solution heat treatments. Since densities are 0.174–0.175 lb/cu in, the maximum strength-to-density ratio observed for these alloys is 1,260,000 inch, a value unmatched in the literature for titanium alloys in the form of 1-inch plate. Even greater strength-to-density values can be confidently expected from thermomechanical processing of the character that has produced exceptional strengths in martensitic steels.

It may be noted that alloys No. 101 and No. 132 have identical values of $B_P$ and $B_T$, and their compositions differ only in that the tin and zirconium contents are reversed based upon the rule that 1 weight per cent Zr = 0.8 weight per cent Sn. However, their tensile properties in the solution treated, or annealed, condition are significantly different. Alloy No. 101 has better ductility and a yield strength-to-ultimate strength ratio of only 0.25 while alloy No. 132 has a yield-to-ultimate ratio of 0.84. Metallographic examination verified that alloy No. 132 has considerably less stress-induced transformation than alloy No. 101 and, consequently, less transformation-induced plasticity. This comparison illustrates the sensitivity of the transformation-induced plasticity to alloy chemistry.

Some of the 1-inch 100-pound plate of alloy No. 101 was rolled at 1200°–1300° F to ½-inch thick plate and evaluated to determine the effects of refining grain size. The tensile test results are summarized in Table XII. The data show exceptionally high strengths and improved ductility over the data for 1-inch coarser-grained plate reported in Table X.

TABLE XII

| Temp. F | Aging Time, hr | Temp. F | Time, hr | Fty ksi | Ftu ksi | Elong. pct | Reduction In Area pct | Rockwell Hardness C Scale |
|---|---|---|---|---|---|---|---|---|
| SOLUTION TREATMENT: 1400° F for ½ HR - AC to 1000° F - WQ | | | | | | | | |
| 1000 | 4 | | | 164 | 196 | 8 | 25.1 | 39.8 |
| 950 | 24 | | | 174 | 184 | 9 | 21.8 | 42.3 |
| 800 | 96 | 950 | 1 | 202 | 213 | 5 | 8.6 | 45.0 |
| ISOTHERMALLY TRANSFORMED FROM 1400° F-½HR | | | | | | | | |
| 1000 | 24 | | | 129 | 141 | 16 | 41.3 | 34.1 |
| 900 | 4 | | | 161 | 177 | 14 | 34.0 | 39.8 |
| 900 | 8 | | | 162 | 181 | 10 | 29.5 | 39.3 |
| 900 | 24 | | | 148 | 160 | 14 | 43.6 | 37.3 |
| 800 | 8 | | | 163 | 183 | 9 | 31.3 | 42.4 |
| 700 | 8 | | | 167 | 194 | 6 | 12.8 | 44.3 |
| 600 | 96 | 950 | 1 | 182 | 198 | 5 | 14.1 | 42.2 |

Alloy No. 101, Ti-11.5V-2Al-2Sn-11.3Zr, demonstrated excellent workability and cold formability characteristics. Sections of 1-inch plate readily rolled to 50 per cent reduction without edge cracking at temperatures as low as 1100° F. Alloy No. 101 in the form of ⅛-inch sheet was rolled to 50 per cent reduction at room temperature without edge cracking; and 5 mil foil was readily produced by alternately rolling to 50 per cent reduction at room temperature and annealing in the beta phase field. Also 1-inch wide strips of 1/16-inch sheet of alloy No. 101 exhibited a minimum bend radius of only 2T in three-point loading. Thus it is seen that the alloy No. 101, Ti-11.5V-2Al-2Sn-11.3Zr, is unique in combining exceptional cold workability in the annealed condition with exceptionally high strength in the age hardened condition. The preferred composition of this invention is: Ti-11.5V-2.0Al-2.0Sn-11.3Zr (quantities expressed in weight per cent).

Alloy No. 132, Ti-11.5V-2Al-2.5Zr-9Sn, in the form of 0.1-inch sheet was cold rolled to 83 per cent reduction at room temperature without intermediate annealing. It is preferred second to alloy No. 101, Ti-11.5V-2.0Al-2.0Sn-11.3Zr.

Figure 5:
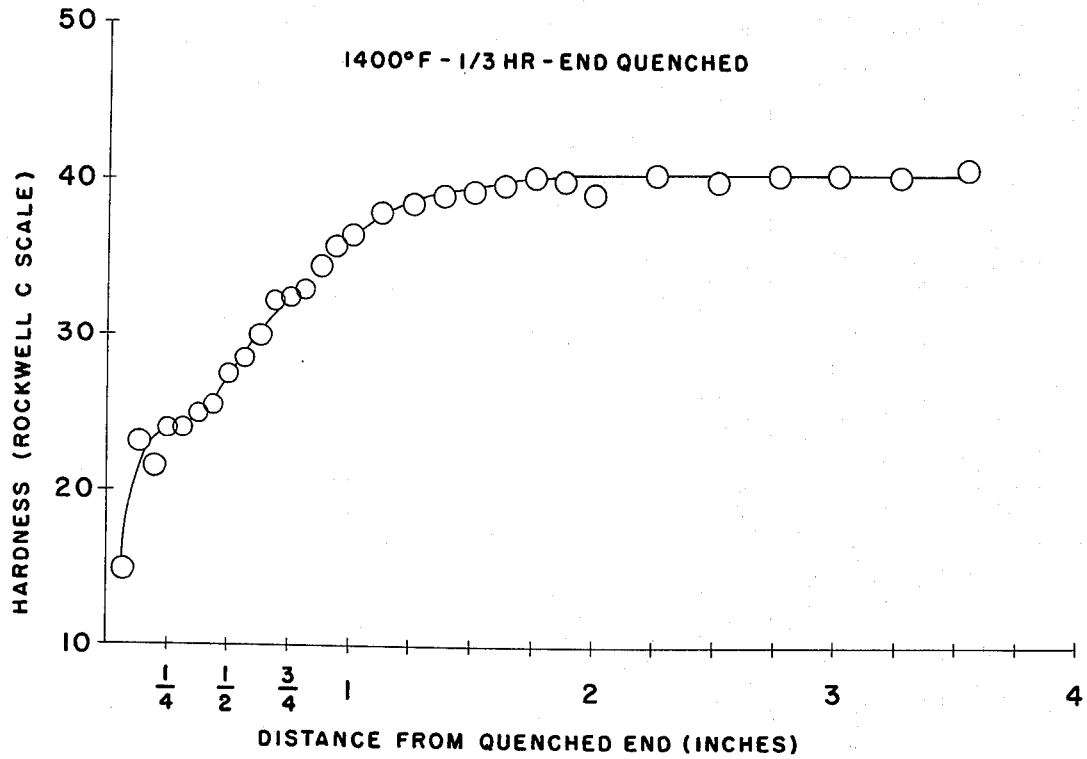
FIG. 5 is a graph for surface hardness traverses for a 1 × 4 inch jominy bar of alloy 101 of this invention in the as-quenched state.
Figure 6:
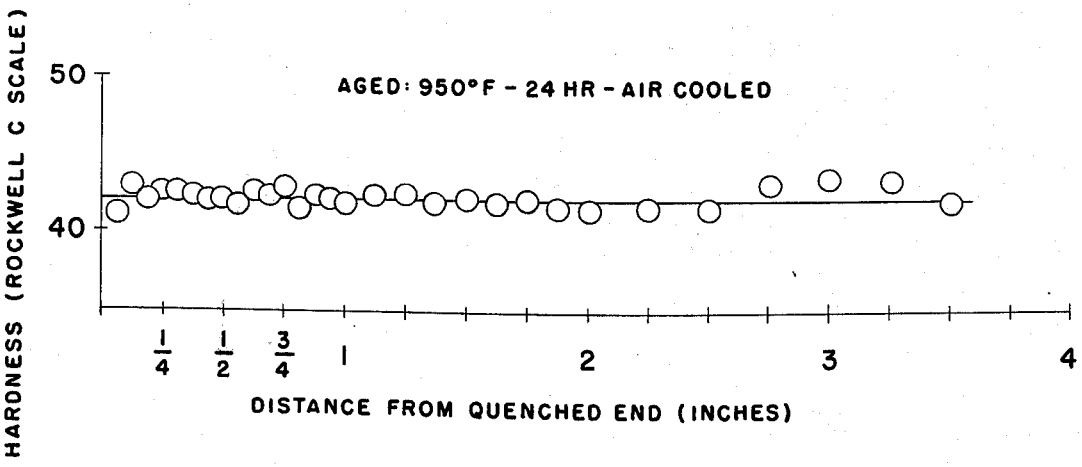
FIG. 6 is a graph similar to FIG. 5 for the same sample after being aged for 24 hours at 950° F.

The exceptional hardenability of alloy No. 101 of this invention is illustrated by FIGS. 5 and 6 which show surface hardness traverses for a 1 × 4 inch Jominy bar in the as-quenched state (FIG. 5) and after being aged at 950° F for 24 hours (FIG. 6). Note that the as-quenched Jominy curve is the reverse of those characteristic of steel. Rapid cooling retains soft beta in alloy No. 101, while slow cooling results in the precipitation of omega, which causes coherency hardening. The aged hardness is remarkably uniform, with an average value of 42.12 ± 0.56 Rockwell C. In alloy No. 101, this corresponds to an average yield strength of 186,000 psi. Note that the bar hardens to at least 3¾ inch length.

While the work done on hardenability of titanium aloys may not yet enable confident relation of Jominy bar distance to ideal diameter, the thermal diffusivities of unalloyed titanium and Ti-75A calculated by other workers are within 33 per cent of the value of 0.009 $in^2$/sec used for hardenability correlations pertaining to steels, and the value calculated for Ti-150A (Ti-2.7Cr-1.4Fe) is within 11 per cent of this value. On the basis of similar thermal diffusivities, correlations for steel suggest that the hardenability of alloy No. 101 in terms of ideal diameters is 7.5 inches.

An alloy capable of being hardened to yield strength levels of 180,000 psi or more in section thicknesses of 4 inch or greater, while satisfying other requisites, has long been sought by titanium users. The titanium alloys of this invention in general, and alloy No. 101 in particular, offer exceptional promise for meeting this need. The exceptional combination of strength potential and hardenability of alloy No. 101 is illustrated by FIG. 7, which reproduces a figure by Wood and Maykuth (R. A. Wood and D. J. Maykuth, "DMIC Review of Recent Developments: Titanium and Titanium Alloys", Defense Metals Information Center, Battelle Memorial Institute, Columbus, Ohio, August 23, 1968, p. 2) with data for alloy No. 101 of this invention.

The alloys of this invention may be made by melt casting in a cold mold, employing an electric arc in an inert atmosphere, or may be produced in other ways in which the alloy is rendered molten and contamination-free before casting. The high hardenability, the transformation-induced plasticity characteristic, and the aging response of the alloys of this invention suggest that they would be excellent for high strength castings. Considering the properties and characteristics of the titanium alloys of this invention, and considering the long standing need that has existed for titanium alloys possessing these characteristics and properties, it is clear that they were not recognized in the prior art or by prior patents.

What is claimed is:

1. A titanium-base alloy capable of being air-cooled from a high temperature body centered cubic beta phase field to room temperature or lower and exhibiting martensitic transformation from the body centered cubic beta phase field and having high formability, high strength, high hardenability and weldability, consisting essentially of a. titanium, as the major component, b. at least one beta stabilizing addition from the group consisting of columbium, cobalt, chromium, iron, manganese, molybdenum, nickel, tantalum and vanadium, in an amount $B_P$ having a molybdenum equivalent, MoEq, of 5.0 to 10.5, and c. at least one percent each by weight of aluminum, tin and zirconium in a total amoant $B_S$ having a molybdenum equivalent, MoEq, of 4.0 to 26.0, where $B_P = \Sigma$ (weight pct of beta stabilizing addition × MoEq per weight pct of beta stabilizing addition) and $B_S = B_P$ [0.15 (weight pct Sn) + 0.12 (weight pct Zr)] + 2 exp (weight pct Sn × weight pct Zr)/50 − 1.9 (weight pct Al)

and the molybdenum equivalents per weight percent of the named beta stabilizing additions are:

| Elements | MoEq |
|---|---|
| Columbium | 0.28 |
| Cobalt | 1.43 |
| Chromium | 1.59 |
| Iron | 2.85 |
| Manganese | 1.56 |
| Molybdenum | 1.00 |
| Nickel | 1.11 |
| Tantalum | 0.22 |
| Vanadium | 0.67 |

2. The alloy of claim 1 having not more than the following maximum percents by weight of the following elements:

| | |
|---|---|
| Oxygen | 0.3 |
| Nitrogen | 0.1 |
| Carbon | 0.2 |
| Hydrogen | 0.03 |
| Boron | 0.2 |
| Silicon | 0.5. |

3. The alloy of claim 1 having, as a beta stabilizing addition, copper in an amount not greater than 75 percent of the total beta stabilizing addition, which still lies within the stated range of $B_P$, wherein copper has a MoEq of 0.77.

4. A titanium-base alloy capable of being air-cooled from a high temperature body centered cubic beta phase field to room temperature or lower and exhibiting martensitic transformation from the body centered cubic beta phase field and having high formability, high strength, high hardenability, and weldability, consisting essentially of a. titanium, as the major component, b. at least one beta stabilizing addition from the group consisting of columbium, cobalt, chromium, iron, manganese, molybdenum, nickel, tantalum and vanadium, in an amount $B_P$ having a molybdenum equivalent, MoEq, of 6.0 to 9.0, and c. at least one percent each by weight of aluminum, tin and zironium in a total amount $B_S$ having a molybdenum equivalent, MoEq, of 6.0 to 20.5, where $B_P = \Sigma$ (weight pct of beta stabilizing addition × MoEq per weight pct of beta stabilizing addition) and $B_S = B_P$ [0.15 (weight pct Sn) + 0.12 (weight pct Zr)] + 2 exp (weight pct Sn × weight pct Zr) /50 − 1.9 (weight pct Al)

and the molybdenum equivalents per weight percent of the named beta stabilizing additions are:

| Elements | MoEq |
|---|---|
| Columbium | 0.28 |
| Cobalt | 1.43 |
| Chromium | 1.59 |
| Iron | 2.85 |
| Manganese | 1.56 |
| Molybdenum | 1.00 |
| Nickel | 1.11 |
| Tantalum | 0.22 |
| Vanadium | 0.67. |

5. The alloy of claim 4 having not more than the following maximum percents by weight of the following elements:

| | |
|---|---|
| Oxygen | 0.3 |
| Nitrogen | 0.1 |
| Carbon | 0.2 |
| Hydrogen | 0.03 |
| Boron | 0.2 |
| Silicon | 0.5. |

6. The alloy of claim 4 having, as a beta stabilizing addition, copper in an amount not greater than 75 percent of the total beta stabilizing addition, which still lies within the stated range of $B_P$, wherein copper has a MoEq of 0.77.

7. A titanium base alloy capable of being air-cooled from a high temperature body centered cubic beta phase field to room temperature or lower and exhibiting martensitic transformation from the body centered cubic beta phase field consisting essentially of titanium and a. one or more beta stabilizers chosen from the group consisting of columbium, cobalt, chromium, iron, manganese, molybdenum, tantalum and vanadium in a total amount of 5 to 10.5 molybdenum equivalent, where the molybdenum equivalent for each said element is its weight percent multiplied by the following factor for that element:

| | |
|---|---|
| Columbium | 0.28 |
| Cobalt | 1.43 |
| Chromium | 1.59 |
| Iron | 2.85 |
| Manganese | 1.56 |
| Molybdenum | 1.00 |
| Nickel | 1.11 |
| Tantalum | 0.22 |
| Vanadium | 0.67 |

b. 1 to 5 weight percent aluminum
c. 1 to 15 weight percent tin, and
d. 1 to 15 weight percent zirconium and where the combination of tin and zirconium which result in exceptionally high hardenability is such that when one of these is present in an amount equal to or less than 5 weight percent, the other is present in an amount equal to or greater than 5 weight percent.

8. The alloy of claim 7 containing no more than the following weight percents of the following elements:

| | |
|---|---|
| Oxygen | 0.3 |
| Nitrogen | 0.1 |
| Carbon | 0.2 |
| Hydrogen | 0.03 |
| Boron | 0.2 |
| Silicon | 0.5. |

9. The alloy of claim 8 wherein the total weight percent of Oxygen plus Nitrogen plus Carbon plus Hydrogen plus Boron plus Silicon does not exceed 0.25 weight percent of the alloy.

10. The alloy of claim 7 wherein copper is present at a weight percent multiplying factor of 0.77 as a said beta stabilizer but does not comprise more than 75 percent of the total beta stabilizer.

11. A titanium base alloy capable of being air-cooled from a high temperature body centered cubic beta phase field to room temperature or lower and exhibiting martensitic transformation from the body centered cubic beta phase field combining good cold formability in the annealed condition with aged ultimate strength of at least 180,000 psi and with ductility, consisting essentially of titanium and about

| | |
|---|---|
| (a) Vanadium | 10 to 13 weight percent |
| (b) Aluminum | 1 to 4 weight percent |
| (c) Tin | 1 to 4 weight percent |
| (d) Zirconium | 9 to 13 weight percent. |

12. The alloy of claim 11 having no more than the following weight percents of each of the following elements:

| | |
|---|---|
| Oxygen | 0.3 |
| Nitrogen | 0.1 |
| Carbon | 0.2 |
| Hydrogen | 0.03 |
| Boron | 0.2 |
| Silicon | 0.3 |
| Iron | 0.2. |

13. The alloy of claim 11 having high toughness due to incorporation of no greater totals of oxygen plus nitrogen plus carbon plus hydrogen plus boron plus silicon than 0.25 weight percent.

14. A titanium base alloy capable of being air-cooled from a high temperature body centered cubic beta phase field to room temperature or lower and exhibiting martensitic transformation from the body centered cubic beta phase field combining good cold formability in the annealed condition with aged ultimate strength of at least 180,000 psi and with ductility, consisting essentially of titanium and about

| | |
|---|---|
| (a) Vanadium | 10 to 13 weight percent |
| (b) Aluminum | 1 to 4 weight percent |
| (c) Zirconium | 1 to 5 weight percent |
| (d) Tin | 7 to 11 weight percent. |

15. The alloy of claim 14 wherein the total weight percent of contained oxygen plus nitrogen plus carbon plus hydrogen plus boron plus silicon is no greater than 0.25.

16. The alloy of claim 15 wherein the weight percent of iron is no greater than 0.2.

17. A titanium base alloy consisting essentially of

| | |
|---|---|
| (a) Vanadium | 11.5 weight percent |
| (b) Aluminum | 2.0 weight percent |
| (c) Tin | 2.0 weight percent |
| (d) Zirconium | 11.3 weight percent |
| (e) Titanium balance. | |

18. The alloy of claim 17 having no more than

| | |
|---|---|
| 0.3 weight percent | Oxygen |
| 0.1 weight percent | Nitrogen |
| 0.2 weight percent | Carbon |
| 0.03 weight percent | Hydrogen |
| 0.2 weight percent | Boron. |

19. The alloy of claim 18 wherein the total of oxygen plus nitrogen plus carbon plus hydrogen plus boron plus silicon is no more than 0.25 weight percent.

20. The alloy of claim 19 having no more than 0.2 weight percent iron.

21. A titanium base alloy consisting essentially of

| | |
|---|---|
| (a) 11.5 weight percent | Vanadium |
| (b) 2.0 weight percent | Aluminum |
| (c) 2.5 weight percent | Zirconium |
| (d) 9.0 weight percent | Tin |
| (e) Balance Titanium. | |

22. The alloy of claim 21 having no more than

| | |
|---|---|
| 0.3 weight percent | oxygen |
| 0.1 weight percent | nitrogen |
| 0.2 weight percent | carbon |
| 0.03 weight percent | hydrogen |
| 0.2 weight percent | boron |
| 0.3 weight percent | silicon. |

23. The alloy of claim 22 wherein the total weight percent of oxygen plus nitrogen plus carbon plus hydrogen plus boron plus silicon is no greater than 0.25.

24. The alloy of claim 23 wherein the iron content does not exceed 0.2 weight percent.

* * * * *